US005876114A

United States Patent [19]

Nino

[11] Patent Number: 5,876,114

[45] Date of Patent: Mar. 2, 1999

[54] REFLECTION MIRROR FOR VEHICLE LAMP AND METHOD OF FORMING THE SAME

[75] Inventor: Naohi Nino, Shizuoka, Japan

[73] Assignee: Koito Manufacturing Co., Ltd., Tokyo, Japan

[21] Appl. No.: 707,376

[22] Filed: Sep. 4, 1996

[30] Foreign Application Priority Data

Sep. 6, 1995 [JP] Japan ..... 7-252041

[51] Int. Cl.[6] ..... F21V 7/09

[52] U.S. Cl. ..... 362/518; 362/297; 362/346

[58] Field of Search ..... 362/517, 518, 362/297, 346, 348

[56] References Cited

U.S. PATENT DOCUMENTS

| | | | |
|---|---|---|---|
| 4,530,042 | 7/1985 | Cibie et al. | 362/309 |
| 4,612,608 | 9/1986 | Peitz | 362/297 |
| 5,171,082 | 12/1992 | Watanabe | 362/61 |
| 5,192,124 | 3/1993 | Kawashima et al. | 362/61 |
| 5,204,820 | 4/1993 | Strobel et al. | 364/468 |
| 5,258,897 | 11/1993 | Nino | 362/346 |
| 5,562,342 | 10/1996 | Nino | 362/346 |
| 5,620,246 | 4/1997 | Uehan | 362/61 |

FOREIGN PATENT DOCUMENTS

| | | |
|---|---|---|
| 2 187 834 | 9/1987 | United Kingdom . |
| 2 271 629 | 4/1994 | United Kingdom . |
| 2 280 740 | 2/1995 | United Kingdom . |
| 2 280 498 | 2/1996 | United Kingdom . |
| 2 298 264 | 8/1996 | United Kingdom . |

*Primary Examiner*—Stephen Husar

*Attorney, Agent, or Firm*—Sughrue, Mion, Zinn, Macpeak & Seas, PLLC

[57] ABSTRACT

In the formation of a basic surface of a reflection surface of a reflection mirror for a vehicle lamp, when a reference curve is established on a horizontal surface containing the optical axis or on an inclined surface inclined with respect to the horizontal surface, a light source, the central axis of which extends along the optical axis, is arranged close to the reference point of the reference curve. Then the reference curve is composed when a hyperbolic portion having a focus on the optical axis and an elliptical portion also having a focus on the optical axis are repeatedly arranged in a direction separate from the optical axis, and an angle of the reflecting light, which has been emitted from the light source, with respect to the optical axis at a point on each curve portion of the reference curve, is determined in such a manner that the closer to the optical axis the curve portion is, the larger the angle is increased. An imaginary paraboloid of revolution is assumed, the axis of which is parallel with the light vector of the reflecting light that has been sent from the reference point on the reference curve and reflected at an arbitrary point on the reference curve, and the imaginary paraboloid of revolution passes through the reflecting point, and its focus is located at the reference point.

25 Claims, 26 Drawing Sheets

REFLECTION MIRROR FOR VEHICLE LAMP AND METHOD OF FORMING THE SAME

BACKGROUND OF THE INVENTION

The present invention relates to a reflection mirror for a vehicle lamp and a method of forming the same in which the central luminous intensity is high and the rays of light are sufficiently diffused in the horizontal direction in the distribution of light used for a vehicle.

In the lamp including a reflection mirror, the shape of which is a paraboloid of revolution, and also including a front lens having lens steps arranged in front of the reflection mirror, it is difficult to make the front lens to be slanted. That is, it is difficult to make the front lens to put into a condition in which the front lens is greatly slanted on a vertical surface in accordance with the shape of a front nose of the vehicle. When the front lens is greatly slanted, the light distribution pattern is curved and the luminous intensity is reduced at both end portions in the transverse direction. In order to solve the above problems, the present applicant proposed a reflection mirror for a vehicle lamp, which is disclosed in U.S. Pat. No. 5,258,897, the summary of which is described below. The light distribution controlling function previously attained by a front lens is laid on the reflection mirror, and by utilizing the overall reflection surface of the reflection mirror, it is possible to form a light distribution pattern having a cut line peculiar to a low beam necessary for the light distribution of a vehicle lamp.

The reflection surface of this reflection mirror has a reference parabola which has been set on a horizontal surface containing the optical axis of the reflection mirror. Alternatively, the reflection surface of this reflection mirror has a reference parabola obtained when a parabola is projected on a horizontal surface containing the optical axis, the parabola being set on a surface rotated by a predetermined angle around the optical axis with respect to the horizontal surface containing the optical axis. A reference point is set on an axis passing through a top and a focus of the reference parabola, wherein the reference point is located on the same side as that of the focus with respect to the top, and a distance from the top to the reference point is longer than the focal distance of the reference parabola. Between the reference point and the focus, there is arranged a light source extending along the optical axis. The reflection surface has an optical axis parallel with a light vector of reflecting light obtained when light assumed to be emitted from the reference point is reflected at an arbitrary point on the reference curve, and the reflection surface is formed as a set of crossing lines obtained when an imaginary surface of paraboloid of revolution passing through the reflecting point, the focus of which is the reference point, is cut by a plane parallel with a vertical axis containing the light vector.

In this connection, in order to obtain a larger horizontal diffusion angle with respect to the above reflection mirror, it is considered to set the parabola, which is a reference curve, to be elliptical or hyperbolic.

FIGS. 41 to 44 are views showing a reflection surface "a" obtained in the following manner. An elliptical reference curve is set on a horizontal surface containing the optical axis. An enveloping surface is obtained by allotting a parabola extending in the vertical direction, to each point, wherein the parabola has an axis parallel with a direction vector of the reflecting light at each point on the reference curve. The thus obtained enveloping surface is a reflection surface "a". In this connection, in these views, a rectangular coordinate system is established, in which the optical axis is determined to be the x-axis, the horizontal axis perpendicular to the x-axis is determined to be the y-axis, and the vertical axis is determined to be the z-axis. The intersection O of these three axes is defined as an origin.

As shown in FIG. 41, a sectional curve "b" obtained when the reflection surface "a" is cut by the x–z plane is not symmetrical with respect to the x-axis. A curve b1 located on the upper side of the x–y plane is formed into a parabola, the focus F1 of which is located on the x-axis. In this case, the focal distance is denoted by f1. A curve b2 located on the lower side of the x–y plane is formed into a parabola, the focus F2 of which is located on the x-axis. In this case, the focal distance is denoted by f2, wherein f2>f1. When a view of the reflection surface "a" is taken from the front, as shown by a solid line in FIG. 42, its outline is not circular, wherein a true circle is described by a broken line. As shown in the drawing, the outline of the reflection surface protrudes downward, that is, the outline of the reflection surface protrudes in the negative direction of the z-axis, and the width of the outline of the reflection surface is reduced in the direction of the y-axis.

In this connection, the filament "c", which is a light source, is assumed to have an ideal shape that is columnar. A central axis of the filament "c" is parallel with the x-axis, and the filament "c" is located between the focuses F1 and F2 under the condition that it comes into contact with the upside of the x-axis.

On the reflection surface "a", the reference curve "d" is set on the x–y plane. As shown in FIG. 43, the top of the reference curve "d" comes into contact with the y-axis at the origin O and is formed into an ellipse, one of the focuses of which is F1. Accordingly, on the assumption that a point light source is arranged at the focus F1, each ray of light emitted from the point light source is reflected on an arbitrary point P on the reference curve "d". Then, as shown by the characters "e", "e", . . . in the drawing, the rays of light are condensed at the other focus of the ellipse located on the x-axis. Then the rays of light cross the x-axis and diffuse in the horizontal direction.

FIG. 44 is a schematic illustration showing an arrangement tendency of the filament images projected on a screen disposed in front of the reflection surface "a" at a sufficiently long distance. In the drawing, the straight line H—H is a horizontal line corresponding to y-axis on the screen, and the straight line V—V is a vertical line corresponding to z-axis on the screen.

As can be seen in the above explanation, the filament images "g", "g", . . . projected on the screen by the regions on the reflection surface "a" on the left of the x–y plane when a view is taken from the front, are arranged under the line H—H on the left of the line V—V. The filament images "h", "h", . . . projected on the screen by the regions on the reflection surface "a" on the right of the x–y plane when a view is taken from the front, are arranged under the line H—H on the right of the line V—V.

In this connection, the closer to the x-axis the reflecting point on the reflection surface "a" is, the larger the projection area is, and the more distant from the x-axis the reflecting point on the reflection surface "a" is, that is, the closer to the periphery the reflecting point on the reflection surface "a" is, the smaller the projection area is. As shown by the rays of light "e", "e", . . . , the closer the ray of reflecting light is to the periphery on the reflection surface "a", the larger the angle of the ray of light with respect to a straight line parallel with the x-axis is increased. Due to the foregoing, the filament image of a small projection area is located at a position distant from the line V—V, and the filament image of a large projection area is located at a position close to the line V—V. In this connection, the filament images "i", "i", . . . , located along the line V—V are projection images formed by the points on the crossing line formed by the reflection surface "a" and the x–z plane.

As shown by the broken line in FIG. 44, a projection pattern obtained as a set of these filament images becomes slender as it separates from the line V—V, that is, the width of the projection pattern in the vertical direction is reduced as it separates from the line V—V.

FIGS. 45 to 48 are views showing a reflection surface "j" obtained in the following manner. An hyperbolic reference curve is set on a horizontal surface containing the optical axis. An enveloping surface is obtained by allotting a parabola extending in the vertical direction, to each point, wherein the parabola has an axis parallel with a direction vector of the reflecting light at each point on the reference curve. The thus obtained enveloping surface is the reflection surface "j". In this connection, in these views, a rectangular coordinate system is established, in which the optical axis is determined to be the x-axis, the horizontal axis perpendicular to the x-axis is determined to be the y-axis, and the vertical axis is determined to be the z-axis. The intersection 0 of these axes is defined as an origin.

As shown in FIG. 45, a sectional curve "k" obtained when the reflection surface "j" is cut by the x–z plane is not symmetrical with respect to the x-axis. A curve k1 located on the upper side of the x–y plane is formed into a parabola, the focus F1 of which is located on the x-axis. In this case, the focal distance is denoted by f1. A curve k2 located on the lower side of the x–y plane is formed into a parabola, the focus F2 of which is located on the x-axis. In this case, the focal distance is denoted by f2, wherein f2>f1. When a view of the reflection surface "j" is taken from the front, as shown by a solid line in FIG. 46, its outline is not circular, wherein a true circle is described by a broken line. As shown in the drawing, the outline of the reflection surface protrudes downward, that is, the outline of the reflection surface protrudes in the negative direction of the z-axis, and the width of the outline of the reflection surface is increased in the direction of the y-axis.

The filament "c", which is a light source, is assumed to have an ideal shape that is columnar. A central axis of the filament "c" is parallel with the x-axis, and the filament "c" is located between the focuses F1 and F2 under the condition that it comes into contact with the upside of the x-axis.

On the reflection surface "j", the reference curve "l" is set on the x–y plane. As shown in FIG. 47, the top of the reference curve "l" comes into contact with the y-axis at the origin 0 and is formed into a hyperbola, the focus of which is F1. Accordingly, on the assumption that a point light source is arranged at the focus F1, each ray of light emitted from the point light source is reflected on an arbitrary point P on the reference curve "l". Then, as shown by the characters "m", "m", . . . in the drawing, the rays of light are gradually separated from the x-axis as they come to the front, that is, as they come in the positive direction of the x-axis, they are diffused in the horizontal direction.

FIG. 48 is a schematic illustration showing an arrangement tendency of the filament images projected on a screen disposed in front of the reflection surface "j" at a sufficiently long distance. In the drawing, the straight line H—H is a horizontal line corresponding to the y-axis on the screen, and the straight line V—V is a vertical line corresponding to the z-axis on the screen.

As can be seen in the above explanation, the filament images "n", "n", . . . projected on the screen by the regions on the reflection surface "j" on the left of the x–y plane when a view is taken from the front, are arranged under the line H—H on the right of the line V—V. The filament images "o", "o", . . . projected on the screen by the regions on the reflection surface "j" on the right of the x–y plane when a view is taken from the front, are arranged under the line H—H on the left of the line V—V.

The closer to the x-axis the reflecting point on the reflection surface "j" is, the larger the projection area is, and the more distant from the x-axis the reflecting point on the reflection surface "j" is, that is, the closer to the periphery the reflecting point on the reflection surface "j" is, the smaller the projection area is. As shown by the rays of light "m", "m", . . . , the closer to the periphery on the reflection surface "j" the ray of reflecting light is, the larger the angle of the ray of light with respect to a straight line parallel with the x-axis is. Due to the foregoing, the filament image of a small projection area is located at a position distant from the line V—V, and the filament image of a large projection area is located at a position close to the line V—V. The filament images "p", "p", . . . located along the line V—V in the vertical direction are images projected from the points on the crossing line formed by the reflection surface "j" and the x–z plane.

As shown by the broken line in FIG. 48, a projection pattern obtained as a set of these filament images becomes slender as it separates from the line V—V, that is, the width of the projection pattern in the vertical direction is reduced as it separates from the line V—V.

In the reflection mirror having the above reflection surface, the following problems may be encountered. It is difficult to ensure both a predetermined central luminous intensity and a diffusion of rays of light in the horizontal direction under the condition that the rays of light have a sufficient width in the vertical direction.

Specifically, in the above reflection surface on which the reference curve is formed to be elliptical or hyperbolic, the following problems may be encountered.

(1) A small filament image projected by the periphery of the reflection surface extends in the horizontal direction.

As explained before with reference to FIGS. 44 and 48, concerning the filament image projected at a position close to the periphery of the reflection surface, the more the filament image is diffused in the horizontal direction, the smaller the projection area will become. Therefore, when the end portions of the projection pattern in the transverse direction are separated from the line V—V in the horizontal direction, the projection pattern becomes slender, so that the visibility is lowered in the periphery.

(2) When an insertion hole to insert the light source is formed on the reflection surface, a luminous intensity at the center of the light distribution pattern is insufficient, that is, a luminous intensity in the hot zone is insufficient.

An insertion hole into which an electric bulb is inserted is formed on the reflection surface at a position close to the intersection where the reflection surface crosses the x-axis. Therefore, in the region AR on the reflection surface shown in FIGS. 41 to 43 or FIGS. 45 to 47, rays of light are not reflected. As a result, an image, the projection area of which is large, is missing as shown by the filament images "i", "i" . . . in FIG. 44 or the filament images "p", "p", . . . in FIG. 48.

An upper end portion of the filament image "i" or "p" contributes to the formation of the central luminous intensity portion. Accordingly, if the upper end portion of the filament image "i" or "p" is missing, the luminous intensity is directly lowered. Unless the filament image, which contributes to the formation of the central luminous intensity portion, is made up by some means for operating the curved surface so that the missing portion can be compensated by other portions, or unless the filament image is made up by the action of lens steps provided on the front lens, it is difficult to sufficiently ensure the luminous intensity of the portion circled by the two-dotted chain line in FIG. 44 or 48.

SUMMARY OF THE INVENTION

In view of the above circumstances, it is an object of the present invention to solve the problems described in the above items (1) and (2) by devising the design of a curved reflection surface.

In order to solve the above problems, the present invention provides a reflection mirror of a vehicle lamp capable of providing a light distribution pattern having a light distribution in which rays of light are diffused in the horizontal direction and the central luminous intensity is maintained at a predetermined level. The reflection mirror has the following features (a) to (e).

(a) A reference curve is set on a horizontal surface containing the optical axis, or the reference curve is obtained when a curve is projected on a horizontal surface containing the optical axis, the curve being set on a surface inclined by a predetermined angle around the optical axis with respect to the horizontal surface containing the optical axis.

(b) The reference curve described in feature (a) is a compound curve formed when a hyperbolic curve portion having a focus on the optical axis and an elliptical curve portion also having a focus on the optical axis are arranged being alternately repeated in a direction separate from the optical axis.

(c) An insertion hole for inserting a light source is formed at a substantial center of the reflection surface, and a central axis of the light source inserted into the reflection mirror through the insertion hole extends along the optical axis, and the light source is located close to a reference point which is set in the front or at the rear of the focus of the reference curve.

(d) The closer the curve portion of the reference curve to the optical axis is, the larger the angle of the reflecting light with respect to the optical axis at a point in each curve portion is.

(e) The reflection surface has an axis parallel with a light vector of reflected light obtained when light assumed to be emitted from a reference point on the reference curve located on the optical axis is reflected at an arbitrary point on the reference curve, and the reflection surface is formed as a set of crossing lines obtained when an imaginary surface of a paraboloid of revolution passing through the reflecting point, the focus of which is the reference point, is cut by an imaginary plane parallel with a vertical axis containing the light vector.

Consequently, according to the present invention, a reference parabola, which is a reference in the design of a reflection surface, is formed by repeatedly arranging a hyperbolic portion and an elliptical portion, and a filament image, the distortion of which is large, having a large projection area, obtained by a portion close to the center of the reflection surface is greatly diffused in the horizontal direction, so that the vertical width at the end portion of the light distribution pattern in the horizontal direction can be sufficiently ensured. Further, a filament image, the distortion of which is small, having a small projection area, obtained by a portion close to the periphery of the reflection surface is controlled so that it can contribute to the formation of a central luminous intensity portion in the light distribution pattern. In this way, it is possible to make up for an insufficient luminous intensity caused by the formation of an electric bulb insertion hole on the reflection surface,

DETAILED DESCRIPTION OF THE INVENTION

A reflection mirror of a vehicle lamp and a method of forming the same according to the present invention will be described in detail as follows.

FIGS. 1 to 20 are views showing a basic surface of the reflection surface and a method of forming the same according to the present invention.

Figure 1:
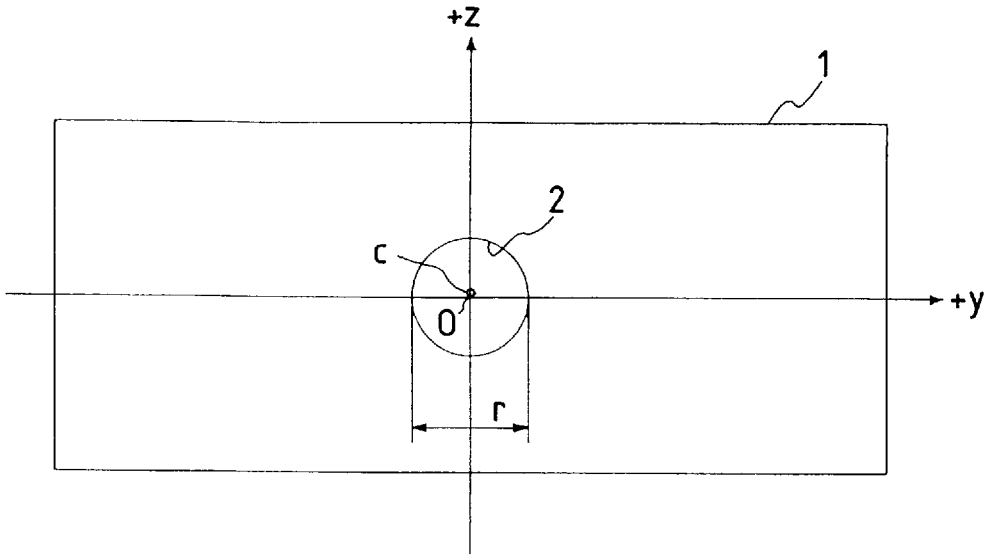
FIG. 1, in conjunction with FIGS. 2 to 21, is a view to explain a method of forming a reflection surface of the present invention, and is a front view of the reflection surface.

FIG. 1 is a front view schematically showing a basic surface 1. An optical axis extending in a direction perpendicular to the surface of the drawing is defined as an x-axis, wherein the viewer's side is defined as a positive direction. A horizontal axis perpendicular to the x-axis is defined as a y-axis, wherein the right in the drawing is defined as a positive direction. The vertical axis is defined as a z-axis, wherein the upper direction in the drawing is defined as a positive direction. By the above axes, a rectangular coordinate system is established, and an intersection O of the three axes is defined as an origin.

On the basic surface 1, there is formed a circular hole 2 when it is seen from the front, and the diameter of the circular hole 2 is "r", and the center of the circular hole 2 is located at the origin O. A light source is arranged inside the reflection mirror through the circular hole 2.

Figure 2:
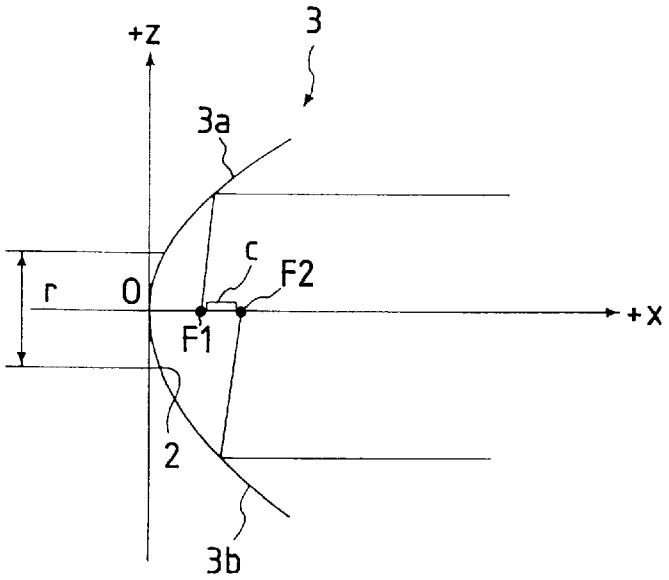
FIG. 2 is a longitudinal cross-sectional view.

FIG. 2 is a schematic illustration showing the shape of a crossing line 3 formed between the basic surface 1 and the x–z plane. A curve 3*a* located on the upside of the x–y plane is a parabola, the focus of which is F1 located on the x-axis. In this case, the focal distance is f1. A curve 3*b* located on the down side of the x–y plane is a parabola, the focus of which is F2 located on the x-axis. In this case, the focal distance is f2, wherein f2>f1.

An electric bulb or an electric discharge lamp may be used as the light source. For example, when an incandescent lamp is used, its light source is composed of a filament. On the assumption that the ideal shape of the filament "c" is columnar, the central axis of the filament "c" is parallel with the x-axis. Under the condition that the filament "c" comes into contact with the x-axis from the upside, it is located between the focuses F1 and F2.

Figure 3:
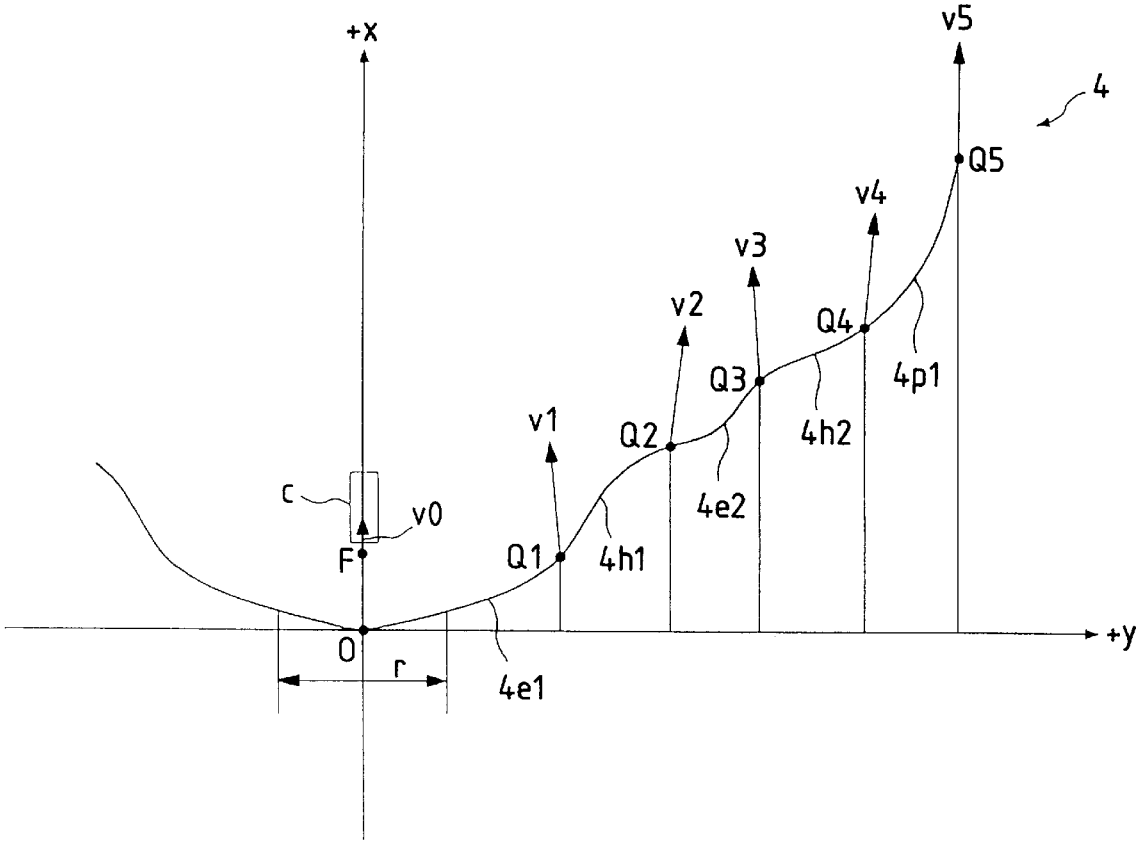
FIG. 3 is a horizontal cross-sectional view.

FIG. 3 is a schematic illustration showing a reference curve 4 established on a horizontal surface containing the x-axis, that is, FIG. 3 is a schematic illustration showing a shape of the crossing line formed between the basic surface 1 and the x–y plane. Since the reference curve 4 is symmetrical with respect to the x–z plane in this example, a portion of the curve established in the first quadrant (x>0, y>0) on the x–y plane is mainly shown in this drawing.

The reference curve 4 is formed in the following manner. A hyperbolic curve portion and an elliptical curve portion, the focuses of which are located on the x-axis, are arranged being alternately repeated in a direction separate from the x-axis. In this case, the focus F does not necessarily coincide with the above focuses F1 and F2. If necessary, the reference curve 4 is formed as a spline curve which is composed by interposing a parabolic curve portion between the hyperbolic curve portion and the elliptical curve portion.

In this connection, the terminologies of "hyperbolic", "elliptical" and "parabolic" are defined by a tendency of the direction of the reflecting light at the reflecting point on the reference curve 4 with respect to a straight line passing through the reflecting point which is parallel with the x-axis. These terminologies are used as modifiers to modify a direction vector of the reflecting light at the reflecting point and also to modify a curve portion composing the reference curve 4.

Figure 4:
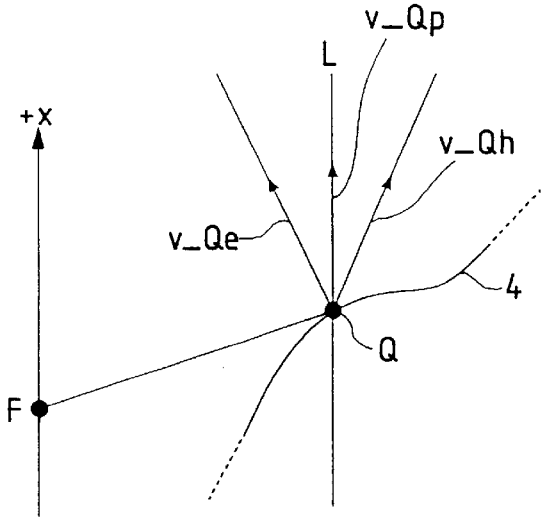
FIG. 4 is a schematic illustration to explain a direction vector of the reflecting light.

FIG. 4 is a view showing the definitions of the above terminologies with respect to the direction vector of the reflecting light.

FIG. 4 illustrates three modes of the unit direction vector which shows a direction of the reflecting light when a ray of light emitted from a point light source to the point Q on the reference curve is reflected at the point Q, on the assumption that the point light source is arranged at the focus F established on the x-axis. In this case, the vector "v_Qp" is a vector which passes through the point Q and extends along the straight line L parallel with the x-axis, wherein the direction of the vector "v_Qp" is the same as the positive direction of the x-axis. The vector "v_Qe" is a vector, the front end of which is directed to the x-axis side. The vector "v_Qh" is a vector, the front end of which is directed to a direction so that it is separate from the x-axis.

Concerning these vectors, in the case of a parabola, on the analogy of the features of geometrical optics that a ray of light emitted from the focus of the parabola and reflected at a point on the parabola advances in parallel with the axis of the parabola, the vector "v_Qp" is defined as "parabolic". In the case of an ellipse, on the analogy of the features of geometrical optics that a ray of light emitted from one of the focuses of the ellipse and reflected at a point on the ellipse crosses the major axis of the ellipse at the other focus, the vector "v_Qe" is defined as "elliptical". In the case of a hyperbola, on the analogy of the features of geometrical optics that a ray of light emitted from one of the focuses of the hyperbola and reflected at a point on the hyperbola is separate from the axis of the hyperbola as it advances, the vector "v_Qh" is defined as "hyperbolic".

Figure 5:
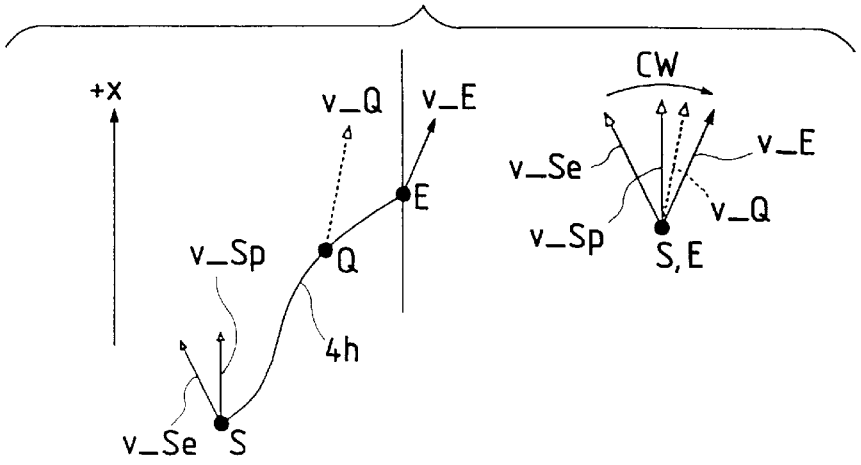
FIG. 5, in conjunction with FIGS. 6 and 7, is a view to explain a curve portion composing the reference curve, and is a view showing a hyperbolic portion.
Figure 6:
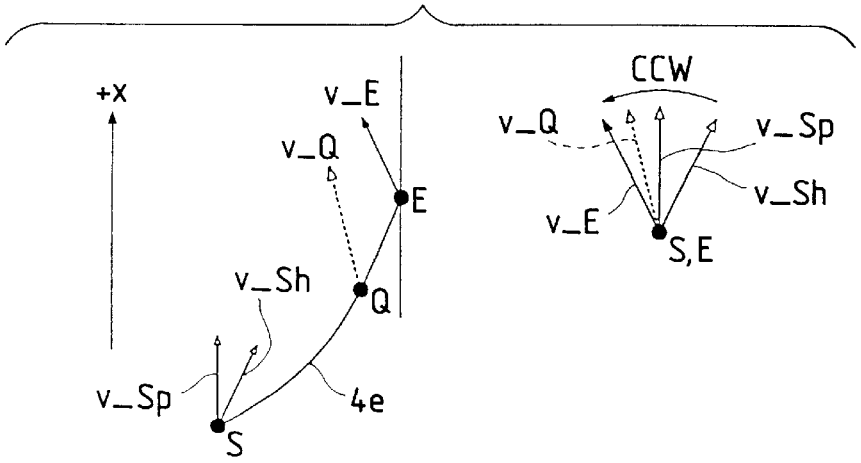
FIG. 6 is a view showing an elliptical portion.
Figure 7:
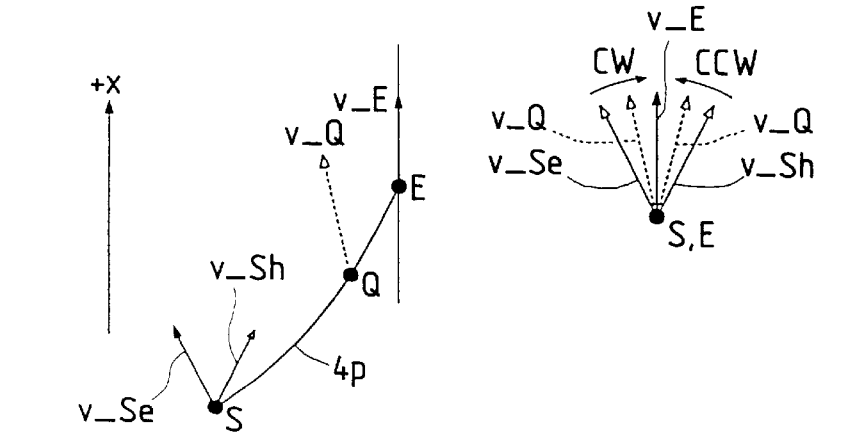
FIG. 7 is a view showing a parabolic portion.

FIGS. 5 to 7 are views to explain the definitions of the above terminologies with respect to a curve portion of the reference curve 4. In these views, the point S is an end point of the curve portion of the reference curve 4 on the x-axis side, and the point E is an end point of the curve portion of the reference curve 4 on the side separate from the x-axis.

FIG. 5 is a view to explain the hyperbolic curve portion 4*h*. The direction vector v_E showing the advancing direction of the reflecting light at the end point E is "hyperbolic". The direction vector showing the advancing direction of the reflecting light at the end point S is "elliptical" as shown by the vector v_Se. Alternatively, the direction vector showing the advancing direction of the reflecting light at the end point S is "parabolic" as shown by the vector v_Sp.

When the vector v_Se or v_Sp is moved in parallel so that the end point S can coincide with the end point E of the vector v_E, the state of vector rotation is made clear as illustrated in the drawing on the right of FIG. 5. That is, the vector v_Q which shows the advancing direction of the reflecting light at an arbitrary point Q on the curve portion 4h coincides with the vector v_Se or the vector v_Sp at the point S. When the point Q moves toward the point E on the curve portion 4*h*, as shown by the arrow CW in FIG. 5, the vector v_Q rotates clockwise and coincides with the vector v_E at the end point E.

FIG. 6 is a view showing the "elliptical" curve portion 4*e*. The direction vector v_E showing the advancing direction of the reflecting light at the end point E is "elliptical". As shown by the vector v_Sh, the direction vector showing the advancing direction of the reflecting light at the end point S is "hyperbolic", or as shown by the vector v_Sp, the direction vector showing the advancing direction of the reflecting light at the end point S is "parabolic".

When the vector v_Sh or v_Sp is moved in parallel so that the end point S can coincide with the end point E of the vector v_E, the state of vector rotation is made clear as illustrated in the drawing on the right of FIG. 6. That is, the vector v_Q which shows the advancing direction of the reflecting light at an arbitrary point Q on the curve portion 4*e* coincides with the vector v_Sh or the vector v_Sp at the point S. When the point Q moves toward the point E on the curve portion 4*e*, as shown by the arrow CCW in FIG. 6, the vector v_Q rotates counterclockwise and coincides with the vector v_E at the end point E.

FIG. 7 is a view showing the "parabolic" curve portion 4*p*. The direction vector v_E showing the advancing direction of the reflecting light at the end point E is "parabolic". As shown by the vector v_Sh, the direction vector showing the advancing direction of the reflecting light at the end point S is "hyperbolic", or as shown by the vector v_Se, the direction vector showing the advancing direction of the reflecting light at the end point S is "elliptical".

When the vector v_Sh or v_Se is moved in parallel so that the end point S can coincide with the end point E of the vector v_E, the state of vector rotation is made clear as illustrated in the drawing on the right of FIG. 7. That is, the vector v_Q which shows the advancing direction of the reflecting light at an arbitrary point Q on the curve portion 4*p* coincides with the vector v_Sh or the vector v_Sp at the point S. When the point Q moves toward the point E on the curve portion 4*p*, in the case where the direction vector at the end point S is the vector v_Se, as shown by the arrow CW in the drawing, the vector v_Q rotates clockwise and coincides with the vector v_E at the end point E. In the case where the direction vector at the end point S is the vector v_Sh, as shown by the arrow CCW in FIG. 7, the vector v_Q rotates counterclockwise and coincides with the vector v_E at the end point E.

As described above, the curve portion composing the reference curve 4 is classified into "hyperbolic", "elliptical" and "parabolic" in accordance with a change in the direction vector of the reflecting light at the point Q on the curve portion between the direction vector of the reflecting light at the boundary point E and the direction vector of the reflecting light at the boundary point S.

Therefore, when these terminologies are used, the reference curve 4 shown in FIG. 3 can be described as follows.

When the reference curve 4 is separate from the x-axis, an elliptical portion and a hyperbolic portion are arranged being alternately repeated, and finally the curve is connected to a parabolic portion. That is, a hyperbolic portion 4*h*1 is adjacent to the right (the positive direction of the y-axis) of an elliptical portion 4*e*1 having a direction vector v0 which is directed to the positive direction of the x-axis at the origin O, and the direction vector v1 of the reflecting light at the boundary point Q1 between both curves is made to be elliptical. An elliptical portion 4*e*2 is adjacent to the right of the curve portion 4*h*1, and further a hyperbolic portion 4*h*2 is adjacent to the right of the elliptical portion 4*e*2. Finally, a parabolic portion 4*p*1, which is located at the most distant position from the x-axis, continues to the hyperbolic portion 4*h*2. The vector v2 is a direction vector of the reflecting light at the boundary point Q2 between the curve portions 4*h*1 and 4*e*2, the vector v3 is a direction vector of the reflecting light at the boundary point Q3 between the curve portions 4*e*2 and 4*h*2, and the vector v4 is a direction vector of the reflecting light at the boundary point Q4 between the curve portions 4*h*2 and 4*p*1. It is clear that the vectors v2 and v4 are hyperbolic and the vector v3 is elliptical.

There is a tendency that the angle formed between the x-axis and each vector v1 to v4 is gradually reduced when the vector is separate from the x-axis. In this example, the angle approaches an angle zero formed by the vector v5 at the end point Q5 of the parabolic portion 4*p*1 located at the end of the reference curve 4 with respect to the x-axis (that is, the vector v5 is parallel with the x-axis).

Figure 8:
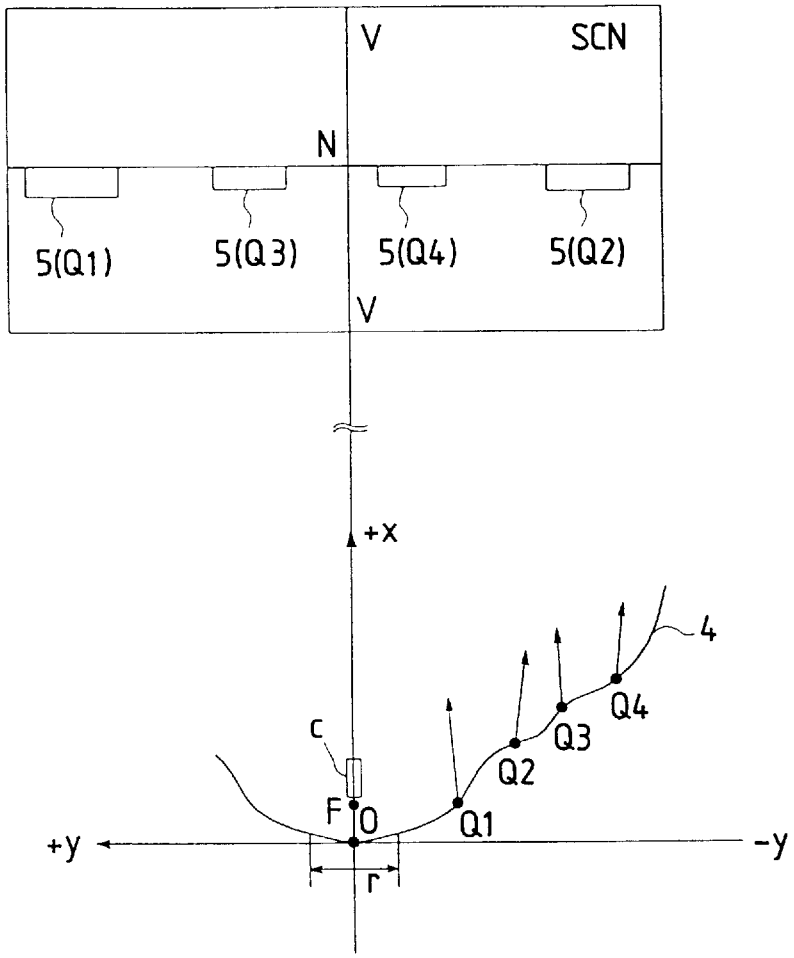
FIG. 8 is a schematic illustration to explain an arrangement tendency of a filament image projected on a screen, which is disposed in front of a boundary point while a sufficiently long distance is maintained, by the boundary point on the reference curve in FIG. 3.

FIG. 8 is a schematic illustration to explain an arrangement tendency of a filament image projected onto the screen SCN by the points which are symmetrical to the boundary points Q1 to Q4 on the reference curve 4 in FIG. 3 with respect to the x–z plane, wherein the screen SCN is located in front of the symmetrical points at a sufficiently long distance. In this case, these symmetrical points are also referred to as the boundary points Q1 to Q4 for the convenience of explanation. The point N shown in the screen SCN is an intersection formed by the x-axis and the screen SCN.

A filament image 5 (Q1) projected at the boundary point Q1 is located at a position distant from the vertical line V—V on the left which passes through the point N and extends in parallel with the z-axis. A filament image 5 (Q2) projected at the boundary point Q2 is located at a position distant from the vertical line V—V on the right. Since the boundary points Q1 and Q2 are located close to the x-axis, the projection areas of these filament images are relatively large.

On the other hand, a filament image 5 (Q3) projected at the boundary point Q3 is located at a point close to the vertical line V—V on the left. A filament image 5 (Q4) projected at the boundary point Q4 is located at a point close to the vertical line V—V on the right. Since the boundary points Q3 and Q4 are located distant from the x-axis, the projection areas of these filament images are relatively small.

As described above, the reference curve 4 has a strong diffusing function in a region close to the x-axis. A region of the reference curve 4 separate from the x-axis contributes to the formation of a luminous intensity distribution in a range close to the vertical line V—V.

Figure 9:
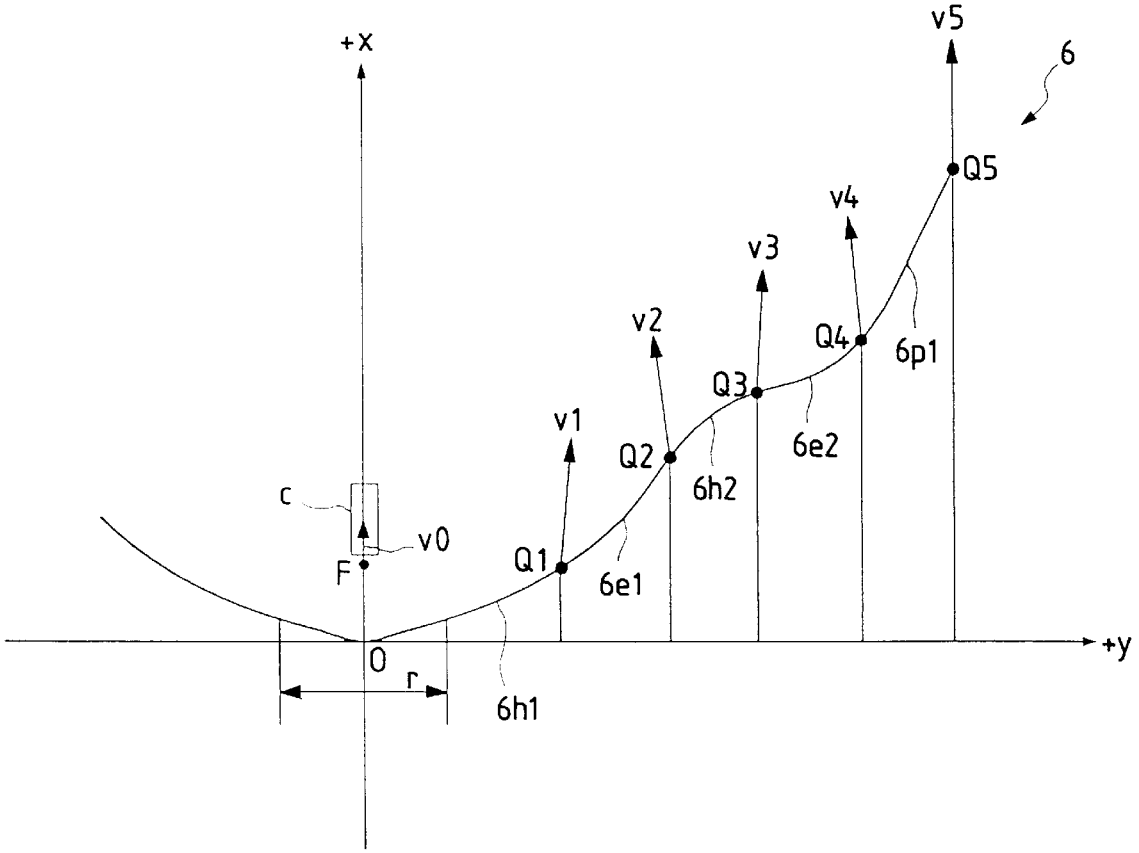
FIG. 9 is a horizontal cross-sectional view showing a different reference curve from the reference curve of FIG. 3.

In this connection, the above reference curve 4 is only an example. It should be noted that the reference curve relating to the present invention is not limited to the specific example of the reference curve 4 shown in FIG. 3. For example, as shown in FIG. 9, the reference curve 6 may be set as a spline curve which is formed as follows. An elliptical portion 6*e*1 is located on the right (the positive direction of the y-axis) of the hyperbolic portion 6*h*1 which is located on the side of the origin O, and the elliptical portion 6*e*1 is adjacent to the hyperbolic portion 6*h*1. A hyperbolic portion 6*h*2 is adjacent to the hyperbolic portion 6*e*1 on the right. An elliptical portion 6*e*2 is adjacent to the hyperbolic portion 6*h*2 on the right. Finally, the elliptical portion 6*e*2 continues to a parabolic portion 6*p*1. In FIG. 9, the vector v1 is a direction vector of the reflecting light at the boundary point Q1 between the curve portions 6*h*1 and 6*e*1, the vector v2 is a direction vector of the reflecting light at the boundary point Q2 between the curve portions 6*e*1 and 6*h*2, the vector v3 is a direction vector of the reflecting light at the boundary point Q3 between the curve portions 6*h*2 and 6*e*2, and the vector v4 is a direction vector of the reflecting light at the boundary point Q4 between the curve portions 6*e*2 and 6*p*1. It is clear that the vectors v1 and v3 are hyperbolic and the vectors v2 and v4 are elliptical. There is a tendency that the angle formed between the x-axis and each vector v1 to v4 is gradually reduced when the vector is separate from the x-axis. In this example, the angle approaches an angle zero formed by the vector v5 at the end point Q5 of the parabolic portion 6*p*1 located at the end of the reference curve 6 with respect to the x-axis (that is, the vector v5 is parallel with the x-axis).

Figure 10A:
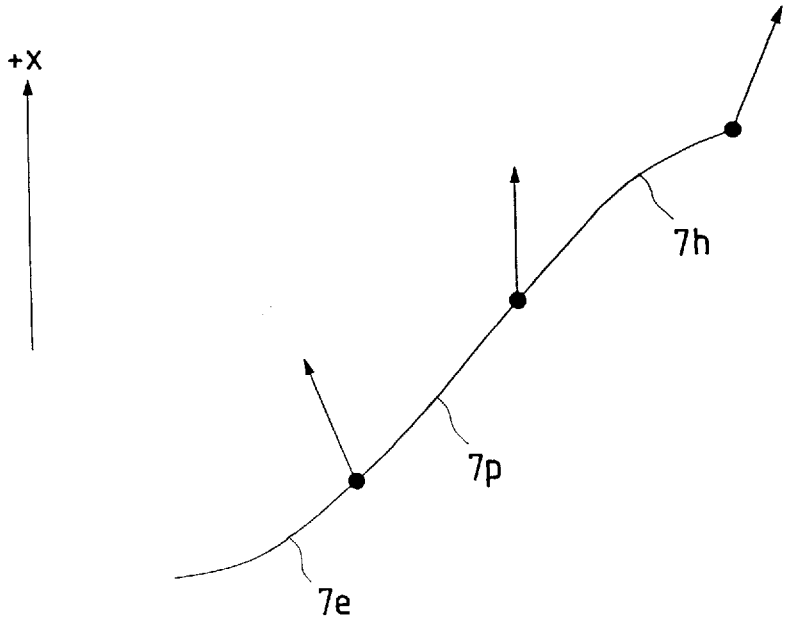
FIGS. 10(*a*) and 10(*b*) are views to explain a method of smoothly connecting a hyperbolic portion with an elliptical portion by interposing a parabolic portion between them, FIG. 10(*a*) being a view showing an example in which a hyperbolic portion is connected with a parabolic portion after the parabolic portion has been made to adjoin an elliptical portion located close to the x-axis, and FIG. 10(*b*) being a view showing an example in which an elliptical portion is connected with a parabolic portion after the parabolic portion has been made to adjoin a hyperbolic portion located close to the x-axis.
Figure 10B:
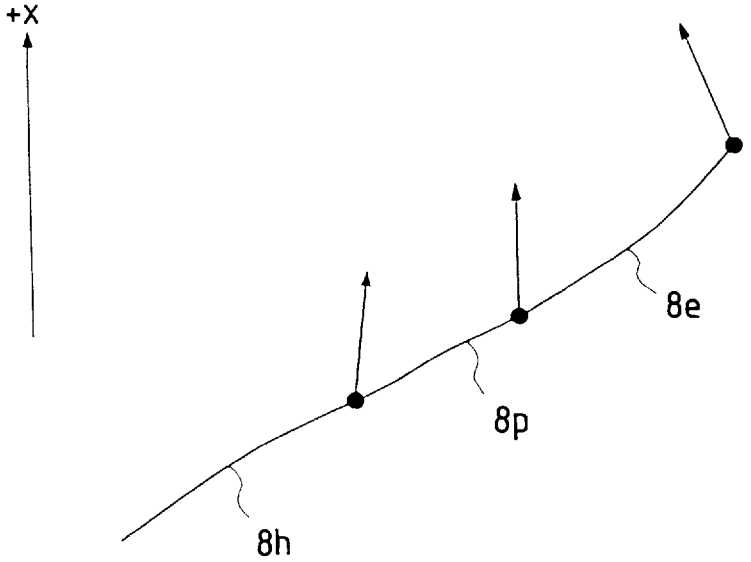

Concerning the reference curve 4 or 6, when a parabolic portion 7*p* is interposed between the elliptical portion 7*e* and the hyperbolic portion 7*h* as shown in FIG. 10(*a*), or when a parabolic portion 8*p* is interposed between the hyperbolic portion 8*h* and the elliptical portion 8e as shown in FIG. 10(*b*), even if a direction of the reflecting light is greatly changed between the elliptical portion and the hyperbolic one, the reference curve can be made to smoothly continue with both curve portions are interpoliated by the parabolic curve portion. That is, since the parabolic portion is neutral with respect to the curve portions located on both sides, a change in the direction vector can be reduced when the parabolic portion is interposed between both curve portions.

In the above explanation, the reference curve 4 is established on the horizontal plan (x–y plane) containing the optical axis. However, it should be noted that the present invention is not limited to the specific embodiment, but the reference curve may be established as follows. A spline curve is established on a plane (a flat plane or a curve plane) which is inclined by a predetermined angle around the x-axis with respect to the horizontal plane containing the optical axis. A curve obtained when the above spline curve is projected on the horizontal plane is determined to be a reference curve. Clearly, the angle theta can be as small as zero degrees, in which case the foregoing explanation for a reference curve on a horizontal plane would apply.

Figure 11:
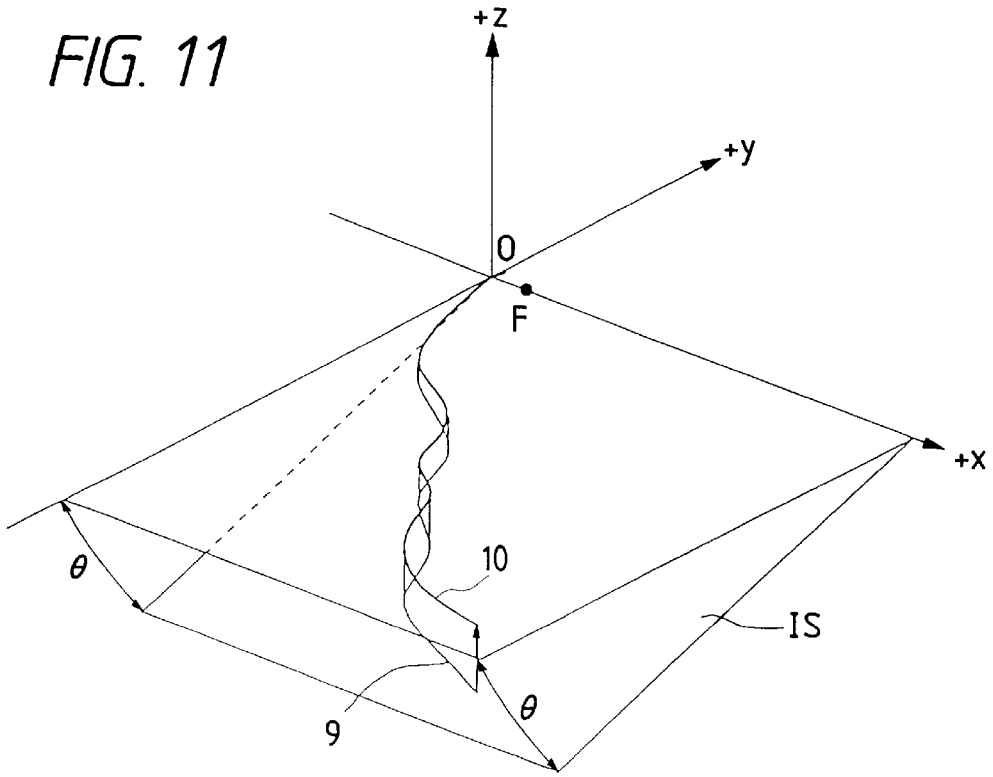
FIG. 11 is a schematic illustration to explain a method of setting a reference curve by projecting a curve to a horizontal surface containing the optical axis, the curve being set on a surface inclined by a predetermined angle around the optical axis with respect to the horizontal surface containing the optical axis.

That is, as shown in FIG. 11, on an inclined surface IS rotated around the x-axis by a predetermined angle (θ) with respect to the x–y plane, a spline curve 9 composed of a hyperbolic portion, an elliptical portion and/or a parabolic portion is established. A curve 10 obtained when the above spline curve 9 is projected onto the x–y plane may be adopted for a reference curve.

As described above, the reference curve is essentially composed as a spline curve in such a manner that an elliptical portion and a hyperbolic one are arranged being alternately repeated, or an elliptical portion and a hyperbolic one are arranged being alternately repeated under the condition that a parabolic portion is interposed between the elliptical portion and the hyperbolic one. In FIG. 3 or 9, the curve portion located at the end of the reference curve is a parabolic portion. However, it should be noted that this curve portion is not necessarily limited to a parabolic portion.

FIGS. 12 to 15 are views to explain a method of forming a basic surface in accordance with the reference curve established in the manner described above.

Figure 12:
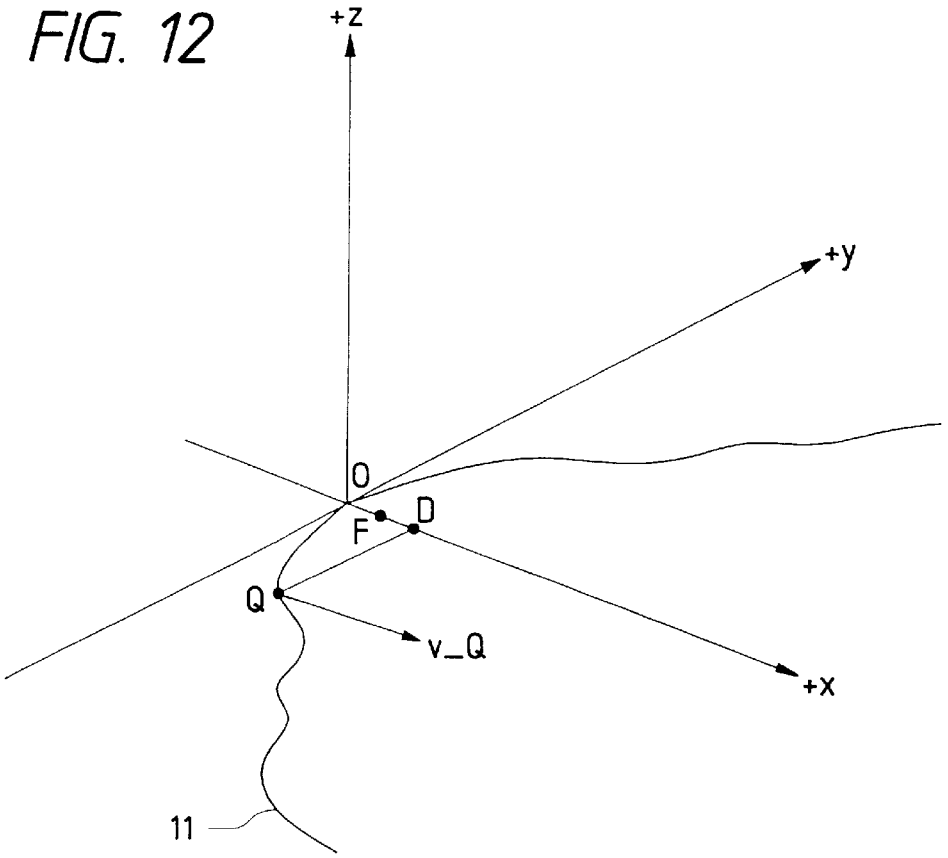
FIG. 12, in conjunction with FIGS. 13 to 15, is a schematic illustration to explain a method of forming a curved surface, and is a schematic illustration showing a reference curve, an arbitrary point Q on the reference curve, and a direction vector of the reflecting light at the point.

As shown in FIG. 12, at the point Q on the reference curve 11, a direction vector v_Q of the reflecting light at the point Q is determined. That is, on the assumption that a point light source is arranged at the reference point D established in the front or at the rear of the focus F on the x-axis, a ray of light emitted from the point light source and reflected at the point Q advances in the direction of the direction vector v_Q.

Figure 13:
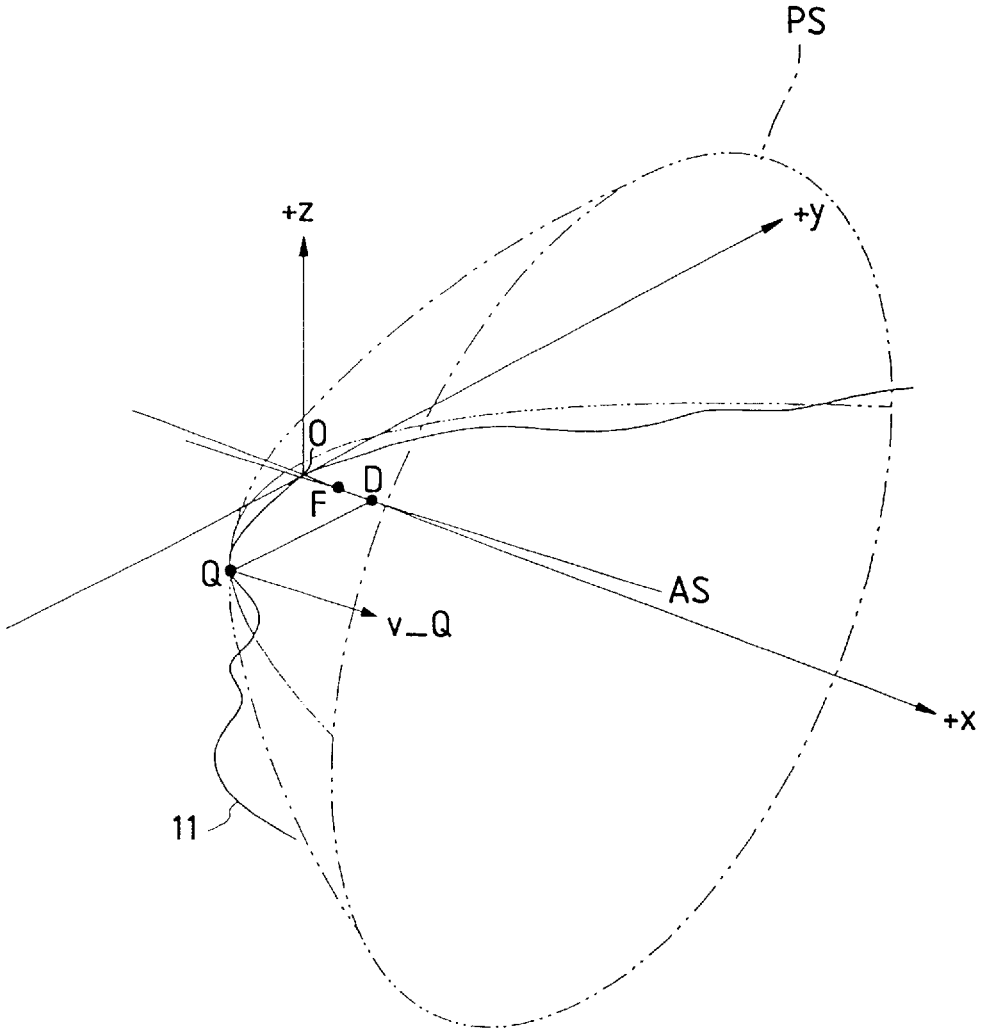
FIG. 13 is a view showing an imaginary paraboloid of revolution with respect to the point Q on the reference curve.

FIG. 13 is a view showing an imaginary surface of paraboloid of revolution PS which is estimated with respect to the point Q. The imaginary surface of paraboloid of revolution PS is a curved surface, the focus of which is the reference point D, having a rotational symmetrical axis AS parallel with the vector v_Q, wherein the point Q is located on the surface PS.

Figure 14:
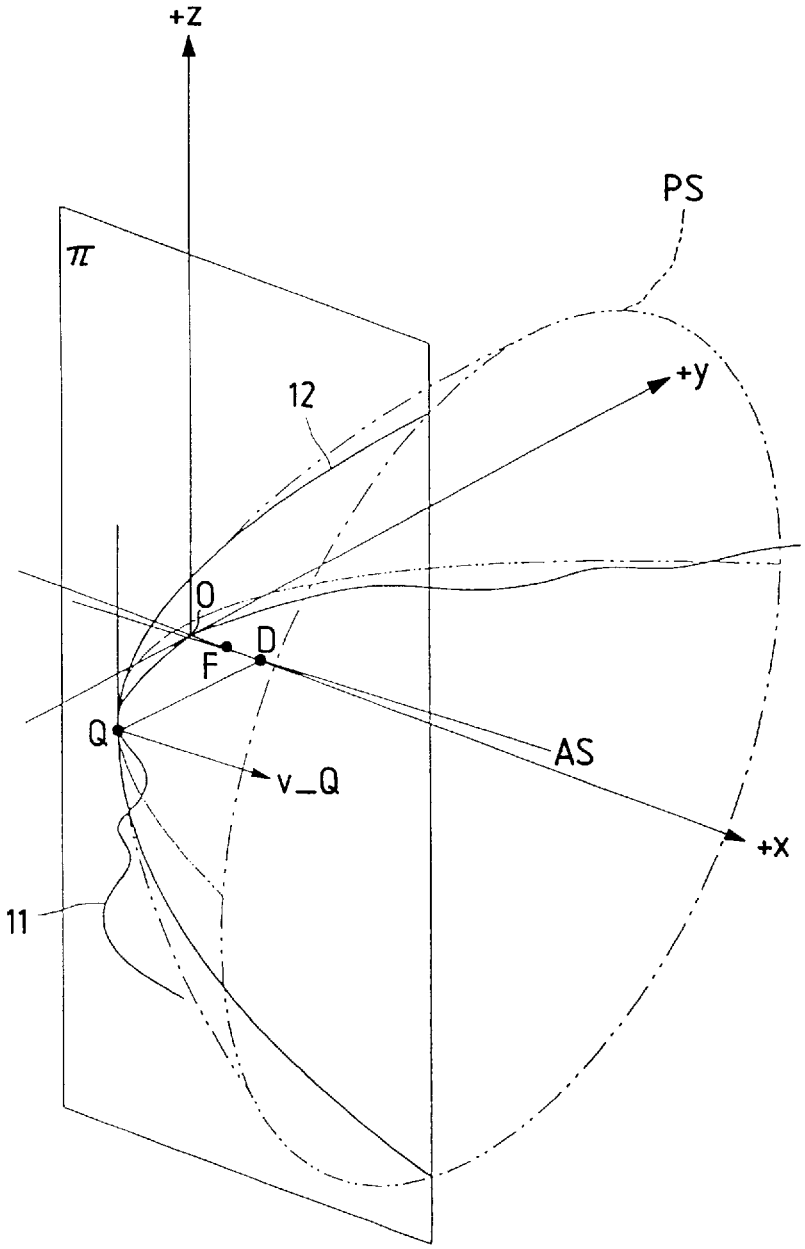
FIG. 14 is a view showing a crossing line formed between an imaginary plane parallel with the z-axis containing a direction vector of the reflecting light at the point Q on the reference curve and an imaginary paraboloid of revolution.
Figure 15:
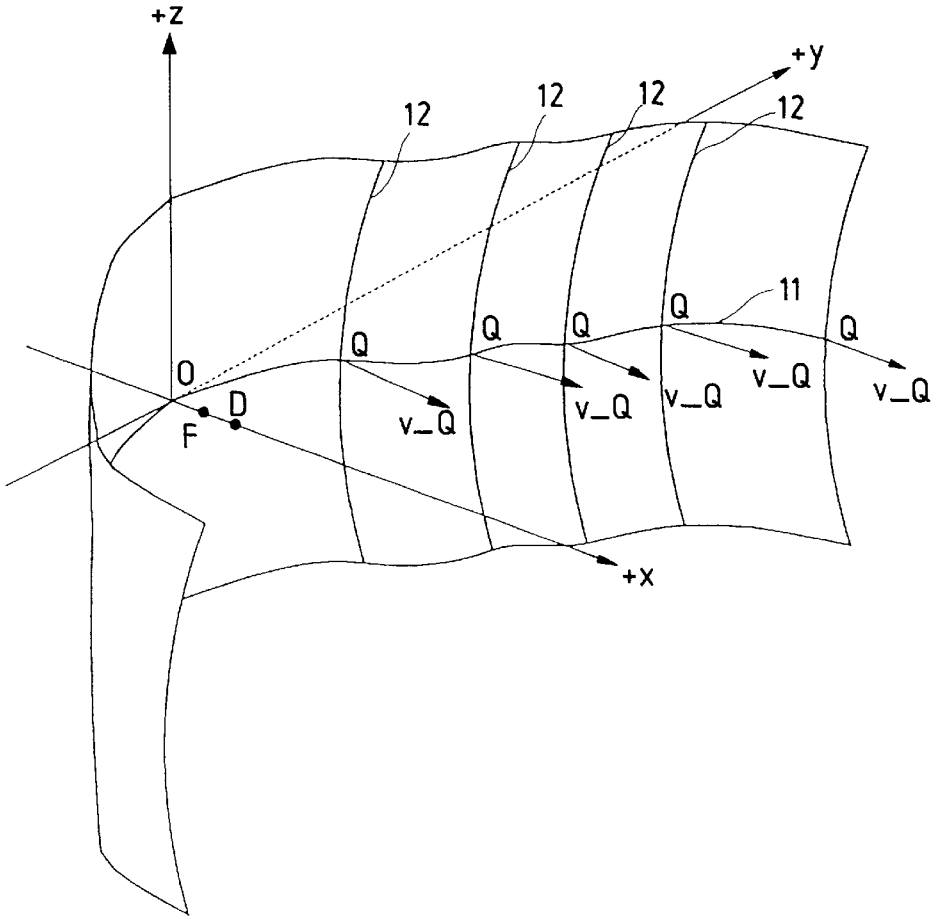
FIG. 15 is a view showing a curved surface obtained as a set of crossing lines in FIG. 14.

As shown in FIG. 14, the above imaginary surface of paraboloid of revolution PS is cut by an imaginary plane $\pi$ which passes through the point Q and is parallel with the z-axis. In this case, a crossing line formed by the imaginary surface of paraboloid of revolution PS and the imaginary plane $\pi$ becomes a parabola 12. The above parabola is uniquely determined at an arbitrary point Q on the reference curve 11. Accordingly, when a parabola 12 is given to each point Q on the reference curve 11 as shown in FIG. 15, a curved surface is formed as a set of parabolas 12. This curved surface is determined to be a basic surface. In other words, the basic surface is obtained as an enveloping surface of the imaginary surfaces of paraboloids of revolution formed along the reference curve 11. In this connection, the number of the points F established on the x-axis is not limited to one, and the position of the reference point D may be different between the upper region and the lower one with respect to the x–y plane.

Figure 16:
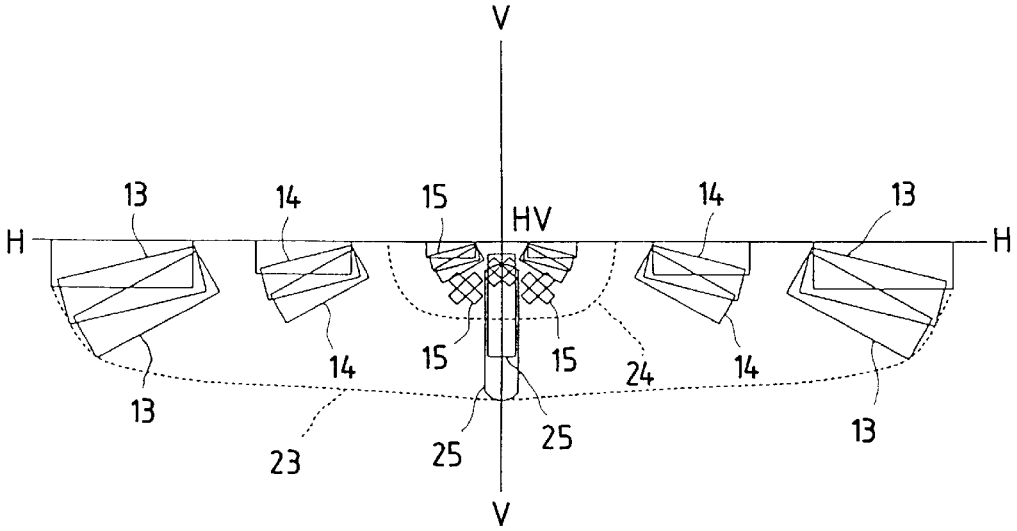
FIG. 16 is a schematic illustration showing an arrangement tendency of a filament image projected by a basic surface of the reflection surface on a screen disposed in front of the reflection surface at a sufficiently distant position.

FIG. 16 is a view schematically showing an arrangement of the filament images projected by the basic surface 1 on a screen disposed at a position sufficiently distant from the basic surface 1. In the drawing, the line H—H is a horizontal line corresponding to the y-axis on the screen, the line V—V is a vertical line corresponding to the z-axis on the screen, and the point HV is an intersection formed by the lines H—H and V—V.

Since the basic surface 1 is symmetrical with respect to the x–z plane in this example, the filament images are arranged symmetrically with respect to the line V—V. These are generally located below the line H—H. The larger the projection area of the filament image is, the more distant from the line V—V the filament image is located. Therefore, the filament image, the projection area of which is small, is located at a position close to the point HV.

Concerning the filament images 13, 13, . . . projected at the positions close to the x-axis on the basic surface 1, the projection areas are large, and they are located at the positions distant from the line V—V. Concerning the filament images 14, 14, . . . projected at the positions a little distant from the x-axis on the basic surface 1, the projection areas are intermediate, and they are located at the positions close to the line V—V compared with the above filament images 13, 13, . . . . Concerning the filament images 15, 15, . . . projected at the positions distant from the x-axis in the periphery of the basic surface 1, the projection areas are small, and they are collected in a relatively small region close to the point HV.

The above arrangement tendency results from the fact that the closer to the x-axis the vector is, the larger the angle formed between the vector and the x-axis is increased in the case of the above reference curve. That is, concerning the elliptical portion and the hyperbolic one, the diffusion angle in the horizontal direction is gradually reduced when it is separate from the x-axis on the reference curve.

Control of the diffusion angle described above is advantageous for the light distribution control condulcted on an incandescent lamp in which the shape of a filament image is affected by a distortion of the shape of a glass bulb surrounding the filament.

Figure 17:
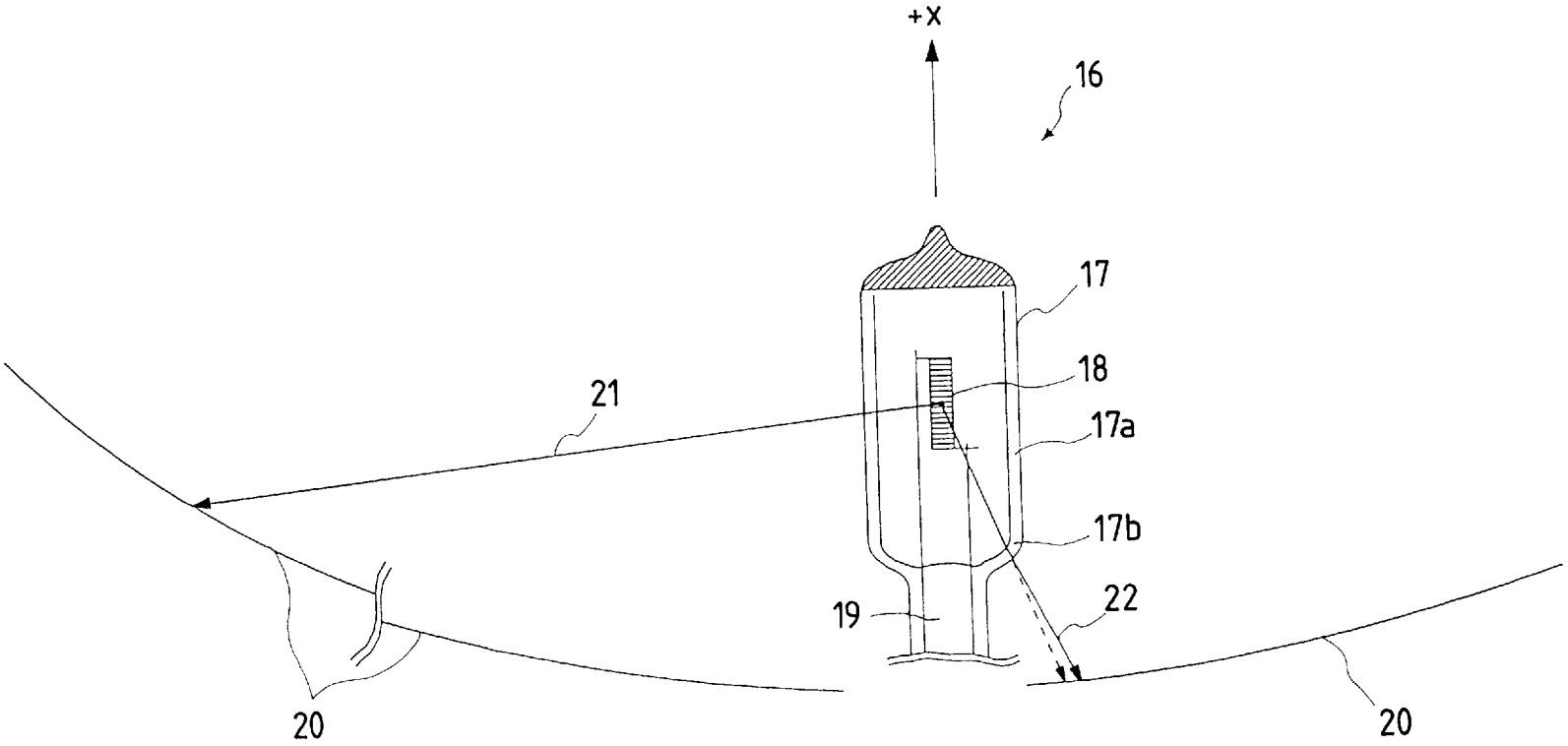
FIG. 17 is a schematic illustration to explain a relation between the structure of an incandescent lamp and the distortion of a filament image.

FIG. 17 is a schematic illustration showing the structure of an incandescent lamp 16. In the glass bulb 17, there is provided a filament 18. A central axis of the filament 18 is arranged in the direction of the x-axis (the optical axis). Since the glass bulb 17 is made in such a manner that it is cut out from a cylindrical glass member and its end portion is sealed, it is difficult to remove a deformation caused in a portion close to the pinch seal portion of the glass bulb. Accordingly, there is a difference between the filament image formation conducted by a ray of light 21 and the filament image formation conducted by a ray of light 22. In this case, the ray of light 21 is emitted from the filament 18 and passes through a cylindrical portion 17*a* of the glass bulb 17, and then it is reflected on a reflection surface 20. The ray of light 22 is emitted from the filament 18 and passes through a portion 17*b* close to the pinch seal portion 19, and then it is reflected on the reflection surface 20. In the latter case, the filament image is distorted by the deformation caused in the neighborhood of the pinch seal portion 19 of the glass bulb.

As can be seen in FIG. 17, the ray of light is emitted from the filament 18 and passes through the portion 17*b* close to the pinch seal portion 19, and then it is reflected on a portion of the reflection surface 20 close to the x-axis. Therefore, this influence appears on a filament image having a large projection area.

From the viewpoint of light distribution control, it is preferable that a filament image, the shape of which is distorted, is greatly diffused in the horizontal direction so that a projection pattern shown by the broken line 23 in FIG. 16 can be formed. In order to attain the above object, it is effective to alternately repeat an elliptical portion and a hyperbolic portion on the reference curve.

On the contrary, a ray of light, which is emitted from the filament 18 and passes through the cylindrical portion 17*a* of the glass bulb 17 and is reflected at a position close to the periphery of the reflection surface 20, is seldom affected by the deformation of the glass bulb 17. Accordingly, it is preferable to control the ray of light in such a manner that the filament images having a small projection area are not diffused so much in the horizontal direction, and they are collected in a portion close to the point HV as illustrated in a range defined by the broken line 24 in FIG. 16, so that these filament images can contribute to the formation of the central luminous intensity portion in the light distribution pattern. Therefore, in order to reduce the contribution of an elliptical portion and a hyperbolic portion on the reference curve, it is effective to reduce their diffusion angles or to increase the contribution of a parabolic portion.

As described above, the filament image, the projection area of which is large, projected at a position close to the optical axis on the basic surface 1, is greatly diffused in the horizontal direction. Accordingly, concerning the projection pattern, which is a set of these filament images, it is possible to maintain the width at the right end portion and the width at the left one in the vertical direction.

The filament image, the projection area of which is small, projected at a position distant from the optical axis on the basic surface 1 contributes to the formation of a portion of the image close to the point HV.

In FIG. 16, the filament images 25, 25 . . . located on the line V—Vin the vertical direction are images projected by the points on the crossing line formed by the basic surface 1 and the x–z plane. The upper end portions of these filament images originally contributes to the formation of the central luminous intensity portion in the light distribution pattern. However, due to the formation of the circular hole 2 to be used as an electric bulb insertion hole, the center is missing. Therefore, the upper end portions of these filament images do not contribute to the formation of the central luminous intensity portion.

However, according to the basic surface of the present invention, the filament images 15, 15, . . . , the projected areas of which are small, are collected in a region shown by the broken line 24 in FIG. 16. Therefore, the lack of luminous intensity caused by the lack of the filament image 25 can be made up by collecting the filament images 15, 15, . . . in the region shown by the broken line 24.

When the above basic surface 1 is subjected to the following operation by which the surface can be formed into a wave-shape, the degree of light diffusion can be more increased.

Figure 18:
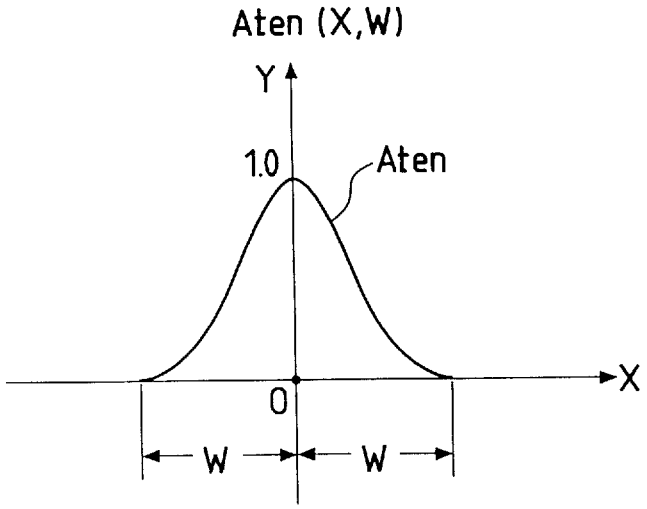
FIG. 18 is a graph showing an example of the normal distribution type function.

First, the normal distribution type function "Aten (X, W) =exp (−(2·X/W)^2) is prepared, in which the parameters X and W are used. In this case, the function "exp( )" expresses an exponential function, and "^" expresses a power. The parameter "W" prescribes a degree of attenuation. The shape of the function Y=Aten (X, W) is shown in FIG. 18.

Figure 19:
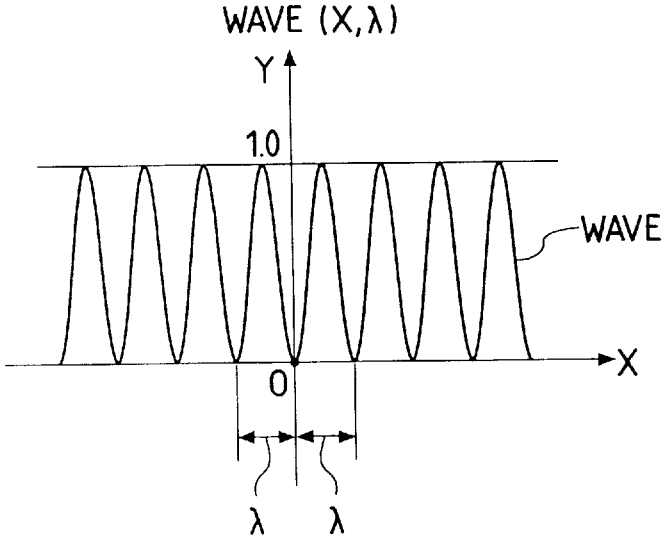
FIG. 19 is a graph showing an example of the periodic function.

Next, the periodic function "WAVE (X, λ)=(1-cos (360°·X/λ))/2 is prepared, in which the parameters X and λ are used. The parameter λ expresses the number of waves of cosine, that is the parameter λ expresses the interval of waves. The shape of the function Y=WAVE (X, λ) is shown in FIG. 19. In this example, the cosine function is used as the periodic function WAVE, however, if necessary, various periodic function may be used.

Figure 20:
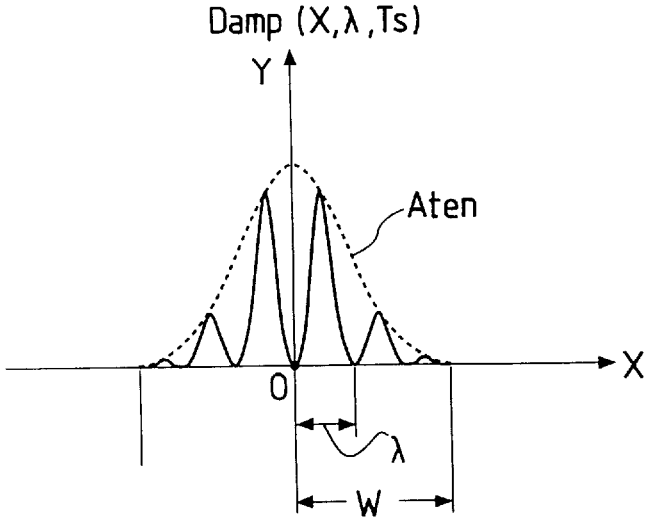
FIG. 20 is a graph showing an example of the damping periodic function.

The above parameter W is defined as W=λ·Ts, and a function obtained when the function Aten(X, W) is multiplied by the function WAVE (X, λ) is defined as a function Damp (X, λ, Ts). Then, as shown in FIG. 20, the function Y=Damp (X, λ, Ts) becomes a periodic function, the value of which is maximum at the point X=0 and decreases as it comes to the periphery.

As described above, when the value of the damped periodic function is added to the expression or the data of the basic surface 1, the reflection surface is given a diffusion action. Due to the foregoing diffusion action, it is possible to diffuse the reflecting light close to the optical axis, and it is also possible to control the reflecting light in the periphery distant from the optical axis so that it can contribute to the formation of the central luminous intensity portion in the light distribution pattern.

It is not necessary that the overall surface is formed into a wave-shape. Only a portion of the surface, for example, only a region close to the optical axis may be formed into a wave-shape.

The method of forming a reflection surface according to the present invention will be summarized as follows.

(1) Selection of a surface on which the reference curve is established, and setting of a light source A curve established on a horizontal plane containing the optical axis, that is, a curve established on the x–y plane is set as a reference curve. Alternatively, a curve obtained when a curve established on the plane inclined by a predetermined angle with respect to the x-axis is projected on the x–y plane, is set as a reference curve. In this case, the light source such as a filament is set at a position close to the reference point D on the reference curve in such a manner that a central axis of the light source extends along the optical axis.

(2) Design of the shape of the reference curve

The reference curve is formed in such a manner that a hyperbolic portion and an elliptical portion, the focuses of which are located on the optical axis, are arranged being alternately repeated in the direction separate from the optical axis. In this case, the shape of the reference curve is prescribed in such a manner that the closer to the optical axis the curve is located, the larger the angle of the reflecting light emitted from the light source and reflected at a point on each curve of the reference curve with respect to the optical axis is increased.

(3) Setting of the imaginary paraboloid of revolution

The imaginary paraboloid of revolution PS is set as follows. The imaginary paraboloid of revolution PS has an axis that is parallel with a light vector v_Q of the reflecting light emitted from the reference point D for the reference curve located on the optical axis and reflected at a point Q on the reference curve. The imaginary paraboloid of revolution PS passes through the reflecting point Q, and the focus of the imaginary paraboloid of revolution PS is the reference point D. In this way, the imaginary paraboloid of revolution PS is established.

(4) Setting of the imaginary plane and computing the crossing line

The crossing line is found when the imaginary paraboloid of revolution PS is cut by an imaginary plane π which contains the light vector v_Q described in the item (3) and is parallel with the vertical axis.

(5) Formation of the enveloping surface as a set of crossing lines

The enveloping surface is formed as a set of crossing lines obtained when the operation described in items (3) and (4) is repeated on an arbitrary point Q on the reference curve.

(6) Forming the surface into a wave-shape

An addition according to a function composed of a product of the normal distribution function and the periodic function is conducted on the reflection surface, so that an overall reflection surface or a portion of the reflection surface is formed into a wave-shape.

The basic surface 1 shown in FIG. 1 is square when a view is taken from the front, however, the front shape of the basic surface of the reflecting surface of the present invention is arbitrarily determined. That is, the front shape of the basic surface of the reflection surface is not limited to a square, but it may be a circle or it may be formed round.

FIGS. 21 to 40 are views showing an embodiment in which the present invention is applied to a reflection mirror of a head lamp for an automobile. The above basic surface 1 is applied to a reflection surface of a rectangular reflection mirror, the front shape of which is long in the transverse direction.

Figure 21:
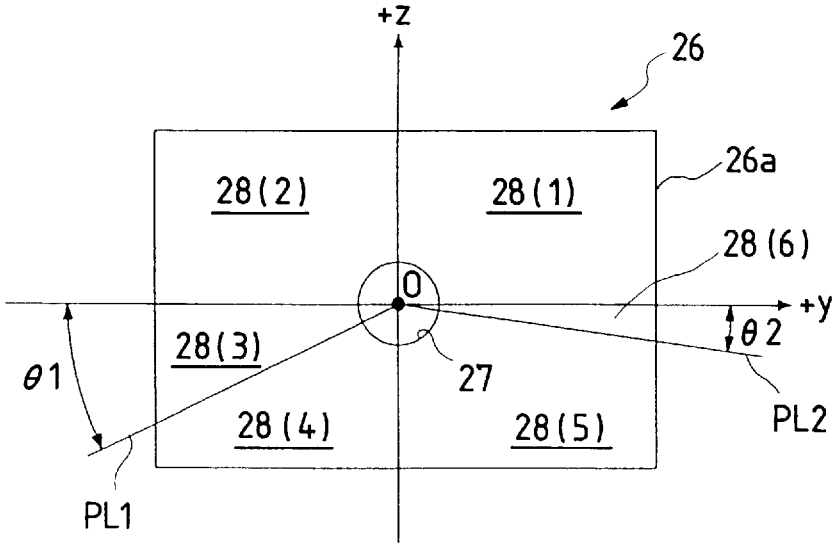
FIG. 21, in conjunction with FIGS. 22 to 40, is a view showing an example of the reflection mirror of the present invention, and is a front view of the reflection surface.

FIG. 21 is a front view of a reflection surface 26*a* of a reflection mirror 26. The optical axis extending in a direction perpendicular to the surface of the drawing is defined as an x-axis, wherein the viewer's side is a positive direction. The horizontal axis perpendicular to the x-axis is defined as a y-axis, wherein the right in the drawing is a positive direction. The vertical axis is defined as a z-axis, wherein the upper direction in the drawing is a positive direction. A rectangular coordinate system is established by these x, y and z axes, and the intersection O of the three axes is defined as an origin O.

On the reflection surface 26*a*, there is provided a circular hole 27 used for inserting an electric bulb, wherein the center of the circular hole 27 coincides with the origin O when a view is taken from the front. A filament, which is a light source, is arranged inside the reflecting mirror through the circular hole 27.

In this case, the reflection surface 26a is divided into six regions 28(i) (i=1 to 6) by the x–z plane, the x–y plane, a semi-plane, referred to as "PL1", inclined counterclockwise around the x-axis by an angle θ with respect to the x–y plane, and a semi-plane, referred to as "PL2", inclined clockwise around the x-axis by an angle θ2 (<θ1) with respect to the x–y plane.

A region 28(1) is located in the first quadrant (y>0, z>0) on the y–z plane when a view is taken from the front. A region 28(2) is located in the second quadrant (y<0, z>0) on the y–z plane when a view is taken from the front.

Regions 28(3) and 28(4) are located in the third quadrant (y<0, z<0) on the y–z plane when a view is taken from the front. One region 28(3) is located on the upside of the semi-plane PL1, and the other region 28(4) is located on the down side of the semi-plane PL1.

The residual regions 28(5) and 28(6) are located in the fourth quadrant (y>0, z<0) on the y–z plane when a view is taken from the front. One region 28(5) is located on the down side of the semi-plane PL2, and the other region 28(6) is located on the upside of the semi-plane PL2.

Figure 22:
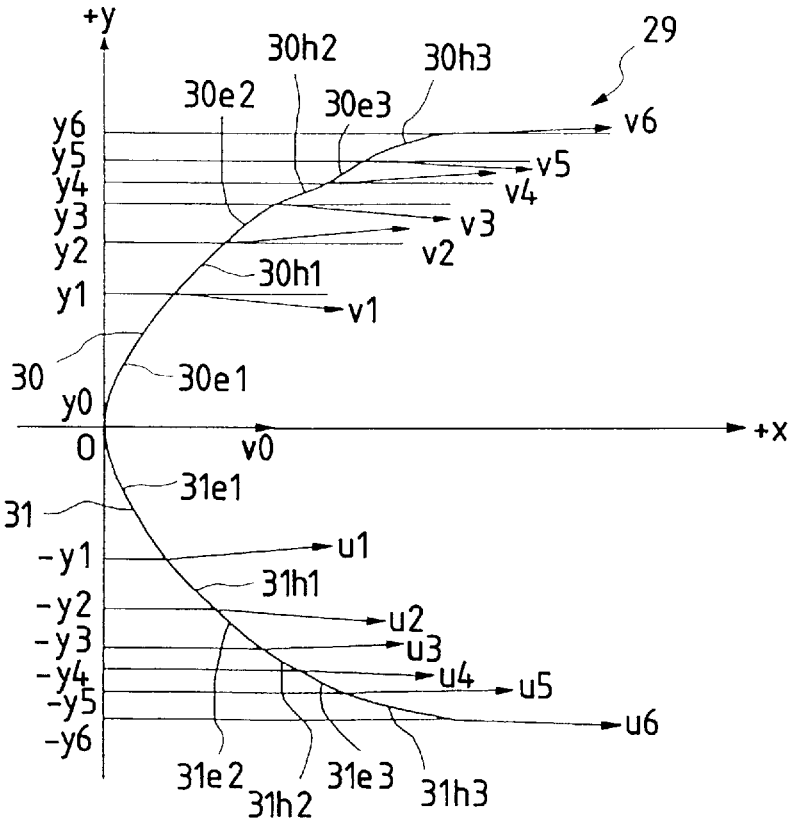
FIG. 22 is a horizontal cross-sectional view.

FIG. 22 is a view showing the shape of a crossing line when the reflection surface 26*a* is cut by the x–y plane.

In this example, the reference curve 29 established on the x–y plane is not symmetrical with respect to the x–z plane. However, a portion of the reference curve 29 located above the x–z plane and a portion of the reference curve 29 located below the x–z plane have a common point of the structure in which an elliptical portion and a hyperbolic portion are arranged being alternately repeated when it is separate from the x-axis.

That is, the reference curve 29 is formed into a spline curve composed as follow. A portion 30 of the reference curve 29 located on the side of y>0 is a spline curve composed of an elliptical portion 30*e*1 located on the origin O side, a hyperbolic portion 30*h*1, an elliptical portion 30*e*2, a hyperbolic portion 30*h*2, an elliptical portion 30*e*3, and a hyperbolic portion 30*h*3 which are arranged in this order from the origin O side in the positive direction of the y-axis.

The coordinate values yi (i=1 to 6) on the y-axis represent the y-coordinate values of the boundary points of each curve. That is, y1 represents the y-coordinate value of the boundary point between the curve portion 30*ea* and 30*h*1, y2 represents the y-coordinate value of the boundrary point between the curve portions 30*h*1 and 30*e*2, y3 represents the y-coordinate value of the boundrary point between the curve portions 30*e*2 and 30*h*2, y4 represents the y-coordinate value of the boundary point between the curve portions 30*h*2 and 30*e*3, y5 represents the y-coordinate value of the boundrary point between the curve portions 30*e*3 and 30*h*3, and y6 represents the y-coordinate value of the end point of the curve portion 30*h*3. In this case, y0=0.

The direction vector vo at the origin O is parabolic. It is directed to the positive direction of the x-axis. The direction vector v1 at the boundrary point between the curve portions 30*e*1 and 30*h*1 is elliptical, the direction vector v2 at the boundrary point between the curve portions 30*h*1 and 30*e*2 is hyperbolic, the direction vector v3 at the boundrary point between the curve portions 30*e*2 and 30*h*2 is elliptical, the direction vector v4 at the boundrary point between the curve portions 30*h*2 and 30*e*3 is hyperbolic, the direction vector v5 at the boundary point between the curve portions 30*e*3 and 30*h*3 is elliptical, and the direction vector v6 at the end point of the curve portion 30*h*3 is hyperbolic.

On the other hand, the reference curve 29 is formed into a spline curve composed as follows. A portion 31 of the reference curve 29 located on the side of y<0 is composed of an elliptical portion 31*e*1 located on the origin O side, a hyperbolic portion 31*h*1, an elliptical portion 31*e*2, a hyperbolic portion 31*h*2, an elliptical portion 31*e*3, and a hyperbolic portion 31*h*3 which are arranged in this order from the origin O side in the negative direction of the y-axis.

In this connection, the coordinate value "−yi" (i=1 to 6) on the y-axis is a value in which the minus sign is added to the above coordinate value "yi" . The coordinate value "−yi" represents a y-coordinate of the boundary point of each curve. The direction vector ul at the boundary point between the curve portions 31*e*1 and 31*h*1 is elliptical, the direction vector u2 at the boundary point between the curve portions 31*h*1 and 31*e*2 is hyperbolic, the direction vector u3 at the boundary point between the curve portions 31*e*2 and 31*h*2 is elliptical, the direction vector u4 at the boundary point between the curve portions 31*h*2 and 31*e*3 is hyperbolic, the direction vector u5 at the boundary point between the curve portions 31*e*3 and 31*h*3 is elliptical, and the direction vector u6 at the end point of the curve portion 31*h*3 is hyperbolic.

Figure 23:
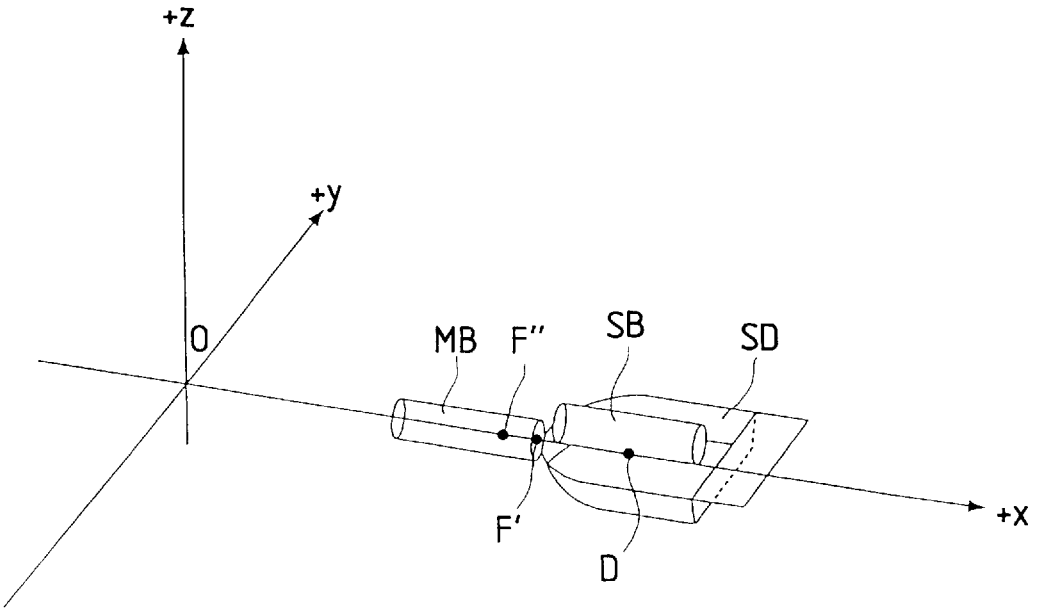
FIG. 23 is a perspective view showing a relation between the arrangements of a filament and a shade and the setting positions of a focus and a reference point.

FIG. 23 is a view showing a positional relation of the filament with respect to the reflection surface. In this embodiment, the light source is composed of an incandescent lamp, which is referred to as an H4 bulb, having two filaments, the central axes of which extend along the optical axis of the reflection mirror 26.

As shown in the drawing, for the convenience of tracing rays of light of the projection image, the shapes of the filaments MB, SB, which are the light sources, are assumed to be columnar, and they are located on the x-axis or at the positions where they come into contact with the x-axis.

That is, the filament MB close to the origin O relates to the formation of a main beam in the light distribution used for automobiles, and the center axis of the filament MB coincides with the x-axis. In this connection, the focus F' relates to the setting of a horizontal reference curve in the regions 28(1), 28(2) on the upper side (z>0) of the x–y plane of the reflection surface 26*a*. The focus F' is determined in such a manner that it coincides with an intersection of the front end face of the filament MB and the x-axis. The focus FΔ relates to the setting of a horizontal reference curve in the regions 28(3), 28(6) on the lower side (z<0) of the x–y plane of the reflection surface 26*a*. The focus FΔ is set at a position a little closer to the origin O than the focus F'.

The filament SB located at a position a little distant from the filament MB in the positive direction of the x-axis relates to the formation of a low beam in the light distribution of automobiles. The central axis of the filament SB is arranged in parallel with the x-axis, and the filament SB comes into contact with the x-axis from the upside. In this case, the reference point D shown in the drawing is set at a middle point of a straight line which connects a point at which the front end face of the filament SB comes into contact with the x-axis, with a point at which the rear end face of the filament SB comes into contact with the x-axis.

Figure 24:
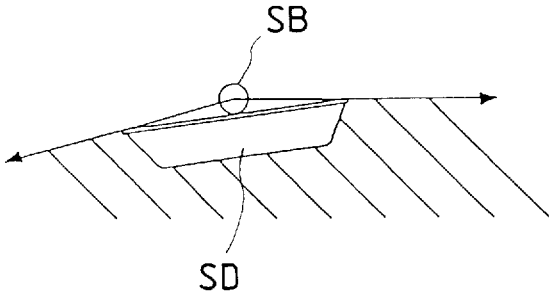
FIG. 24 is a front view showing a positional relation between the filament of a low beam and the shade.

Below the filament SB, there is provided a shade SD, the shape of which is a substantial boat-shape. As shown in FIG. 24, the shade SD is fixed to a support member (not shown) in the glass bulb under the condition that an upper edge portion of the shade SD is a little inclined with respect to the horizontal plane. This shade SD is provided for shading all light which advances from the filament SB to the regions 28(4), 28(5) and also for shading a portion of light which advances from the filament SB to the regions 28(3), 28(6) in the case of irradiation of a low beam.

FIGS. 25 to 29 and FIGS. 31 to 37 are views to explain an arrangement of the filament images projected by each reflecting region on a screen located in front of the reflection surface 26*a*. In these views, the line H—H is a horizontal line corresponding to y-axis on the screen, and the line V—V is a vertical line corresponding to z-axis on the screen. The point HV is an intersection of the lines H—H and V—V.

The filament image shown in the drawing is an exemplary image projected by several representative points selected on the crossing lines formed by the planes of y=yi or y=−yi (i=1 to 6), y=y0 and the reflecting plane 26*a*.

FIGS. 25 to 29 are views showing examples of the arrangement of the filament image in the case of irradiation of a low beam.

Figure 25:
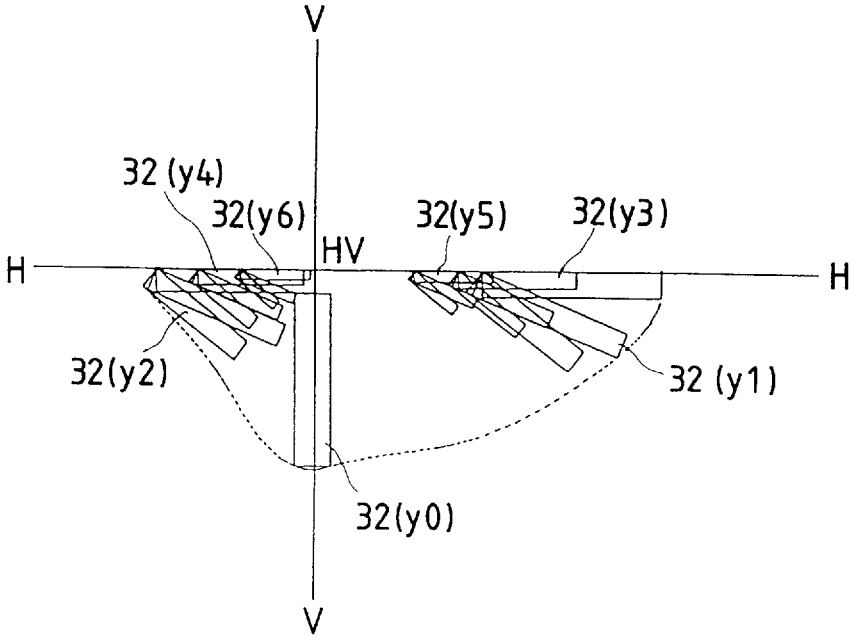
FIG. 25, in conjunction with FIGS. 26 to 29, is a schematic illustration of the projection pattern in each region on the reflection surface in the case of irradiation of a low beam, and is a view showing an arrangement tendency of the filament image formed by the region 28(1) and also showing a projection pattern.

FIG. 25 is a view showing an arrangement of the filament images projected by the region 28(1). The filament image 32(yi) (i=1 to 6) located substantially below the line H—H is a filament image projected by several representative points selected on the crossing line formed by the plane y=yi (i=1 to 6) and the region 28(1).

As shown in the drawing, the filament images 32(y1), 32(y3), 32(y5) are located on the right of the line V—V, and the higher the y-coordinate value is, the closer to the line V—V the filament image 32 is located.

The filament images 32 (y2), 32 (y4), 32(y6) are located on the left of the line V—V, and the higher the y-coordinate value is, the closer to the line V—V the filament image 32 is located.

The reason why the above arrangement tendency is provided is that the closer to the x-axis the direction vector is on the reference curve, the larger the angle with respect to the x-axis is increased.

The filament image 32 (y0) located on the line V—V is a projection image located on the boundary line between the regions 28(1) and 28(2). In this case, the boundary line is a portion of the crossing line formed by the plane of y=y0 (=0) and the reflection surface 26*a* on the side of z>0.

Figure 26:
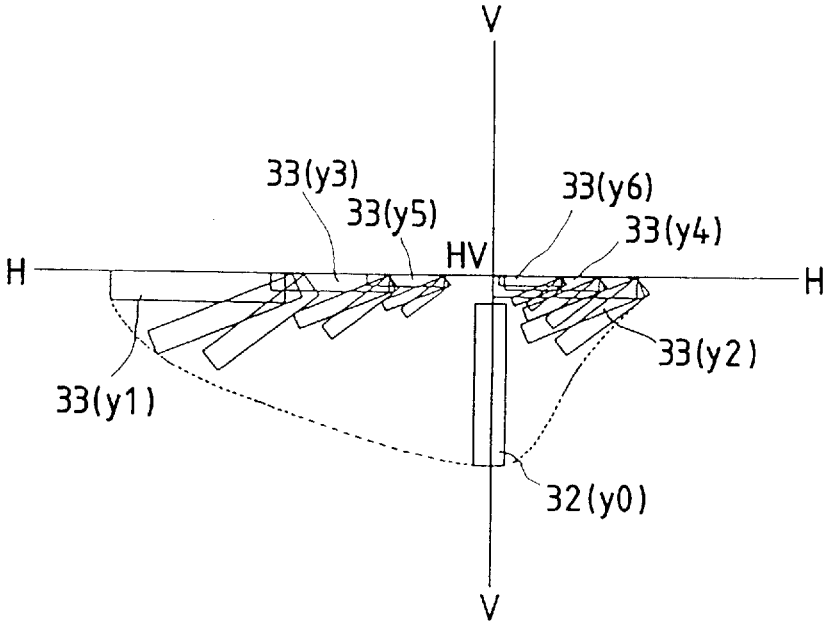
FIG. 26 is a view showing an arrangement tendency of the filament image formed by the region 28(2) and also showing a projection pattern.

FIG. 26 is a view showing an arrangement tendency of the filament image projected by the region 28(2). The filament images 33(yi) (i=1 to 6) located below the line H—H are filament images projected by several representative points on the crossing line where the plane y=yi (i=1 to 6) crosses the curved surface of the region 28(2). In this case, the arrangement tendency is opposite to that of the filament image 32 (yi) with respect to the line V—V.

That is, the filament images 33(y1), 33(y3) and 33(y5) are disposed on the left of the line V—V. The higher the coordinate value of the filament image is, the closer to the V—V line the filament image is located.

Also, the filament images 33(y2), 33(y4) and 33(y6) are disposed on the right of the line V—V. The higher the y-coordinate value of the filament image is, the closer to the line V—V the filament image is located.

Figure 27:
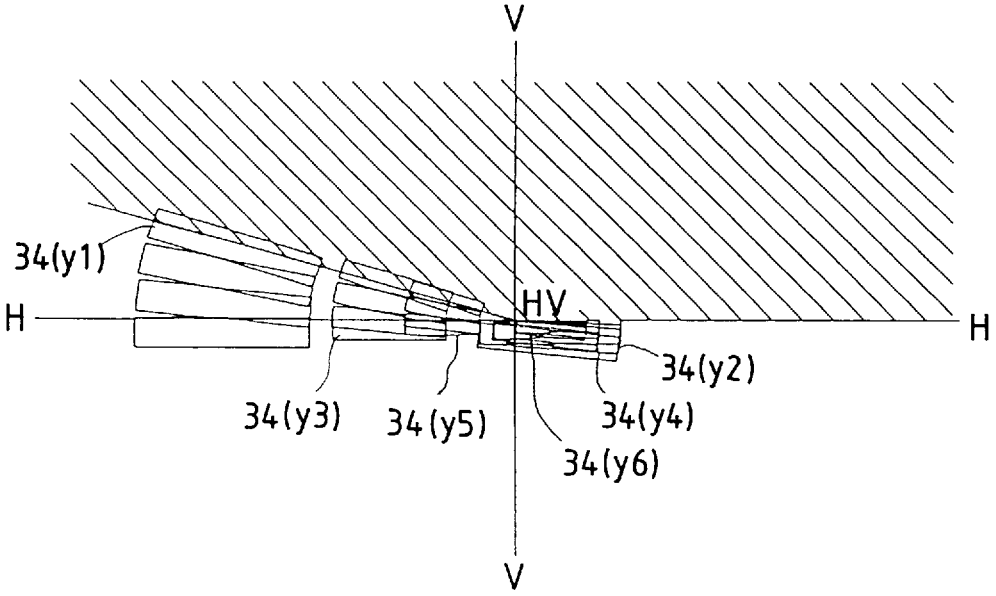
FIG. 27 is a view showing an arrangement tendency of the filament image formed by the region 28(3) and also showing a projection pattern.

FIG. 27 is a view showing an arrangement of the filament images projected by the region 28(3). The filament images 34(yi) (i=1 to 6) located at a position close to the line H—H or a little upper position with respect to the line H—H are filament images projected by several representative points on the crossing line where the plane y=yi (i=1 to 6) crosses the curved surface of the region 28(3).

The filament images 34(y1), 34(y3) and 34(y5) are located on the left of the line V—V. They are arranged substantially radially around the point HV. The higher the y-coordinate value of the filament image is, the closer to the line V—V the filament image is located.

The filament images 34(y2), 34(y4) and 34(y6) are collected in a relatively small region located on the right at a lower position with respect to the point HV. The higher the y-coordinate value of the filament image is, the closer to the line V—V the filament image is located.

The hatched portion in the drawing is a masked region in which rays of light emitted from the low beam filament SB are shut off by the shade SD.

Figure 28:
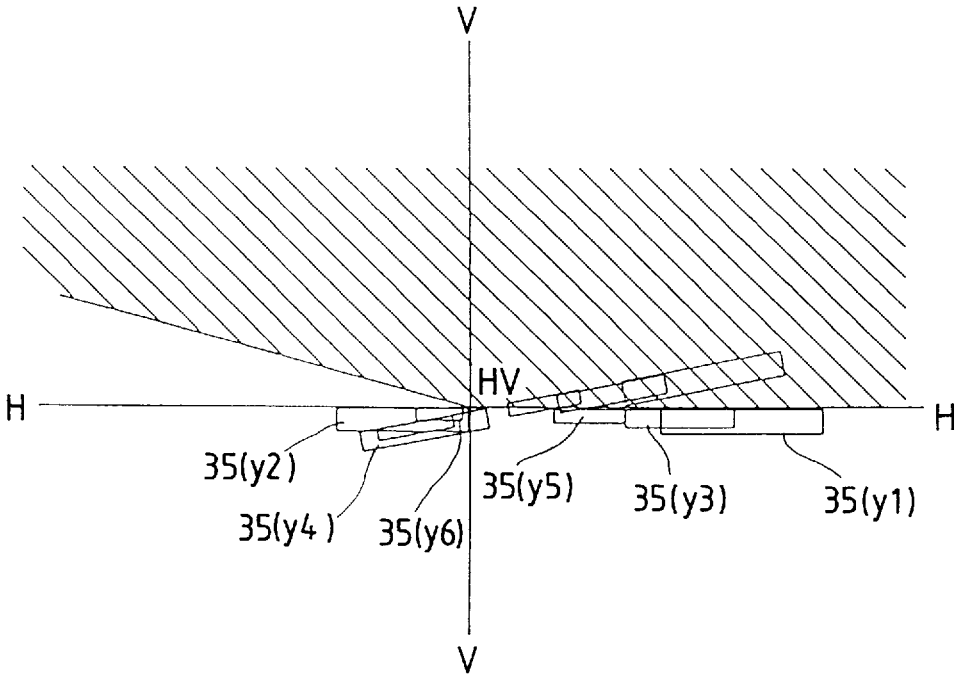
FIG. 28 is a view showing an arrangement tendency of the filament image formed by the region 28(6) and also showing a projection pattern.

FIG. 28 is a view showing an arrangement of the filament images projected by the region 28(6). The filament images 35(yi) (i=1 to 6) located at a position close to the line H—H or a little upper position with respect to the line H—H are filament images projected by several representative points on the crossing line where the plane y=yi (i=1 to 6) crosses the curved surface of the region 28(6).

The filament images 35(y1), 35(y3) and 35(y5) are located on the right of the line V—V. They are arranged substantially radially around the point HV. The higher the y-coordinate value of the filament image is, the closer to the line V—V the filament image is located.

The filament images 35(y2), 35(y4) and 35(y6) are collected in a relatively small region located on the left at a lower position with respect to the point HV. The higher the y-coordinate value of the filament image is, the closer to the line V—V the filament image is located.

The hatched portion in the drawing is a masked region in which rays of light emitted from the low beam filament SB are shut off by the shade SD.

Figure 29:
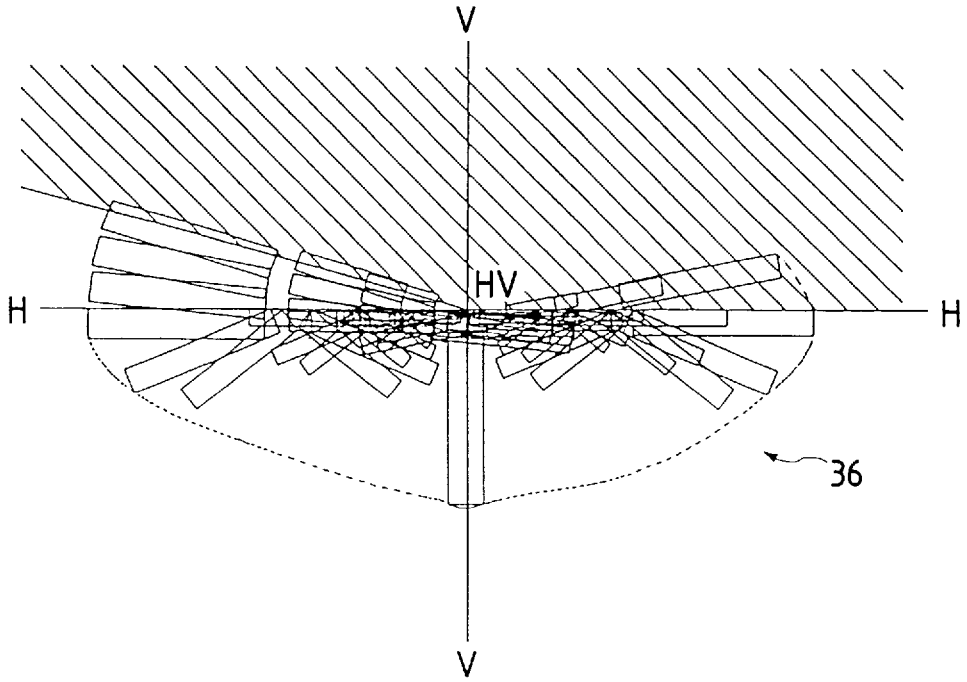
FIG. 29 is a view showing a projection pattern compounded by the regions 28(1) to 28(3) and the region 28(6).

FIG. 29 is a schematic illustration showing the projection pattern 36 obtained as a set of filament images having the aforementioned arrangement tendency.

The projection pattern 36 is formed into a substantial heart-shape. An upper edge portion of the projection pattern 36 protrudes to an upper portion with respect to the line H—H, and a hatched portion on the drawing is a portion in which rays of light are shut off by the shade SD.

As can be seen in the drawing, the smaller the projection area of the filament image is, the closer to the point HV the filament image is located.

Figure 30:
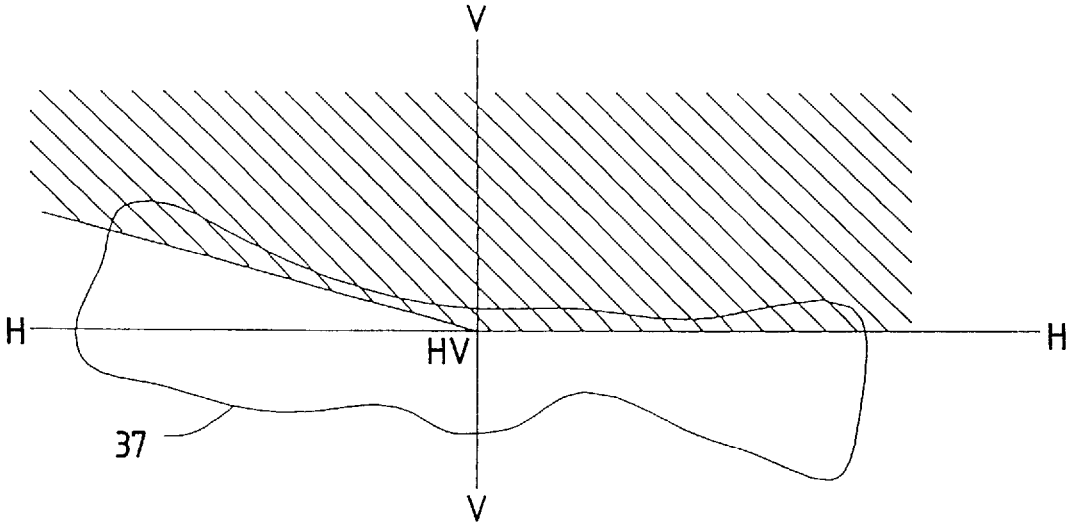
FIG. 30 is a schematic illustration of the projection pattern reflected by a reflection surface that is obtained by an addition of the damping periodic function with respect to a basic surface of the reflection surface.

FIG. 30 is a schematic illustration of the projection pattern 37 formed by the reflection surface 26*a* which has been formed into a wave-shape in the manner described before.

In this embodiment, only a region on the reflection surface 26*a* close to the x-axis is subjected to the wave-form processing by the damping periodic function. Due to the foregoing, the projection pattern 37 is more diffused in the horizontal direction than the projection pattern 36, and a region taking part in the formation of cut lines is extended. In this connection, an inclined cut line that is inclined with respect to the line H—H, and a horizontal cut line that is parallel with the line H—H are formed by masking the hatched portion in the drawing by the shade SD.

FIGS. 31 to 37 are views showing examples of the filament image arrangement when irradiation is conducted by the main beam.

Figure 31:
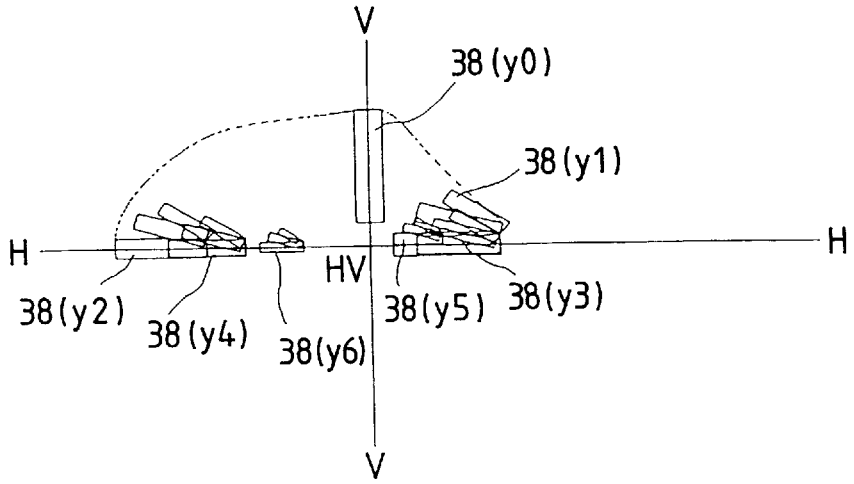
FIG. 31, in conjunction with FIGS. 32 to 37, is a schematic illustration of the projection pattern in each region on the reflection surface in the case of irradiation of a main beam, and is a view showing an arrangement tendency of the filament image formed by the region 28(1) and also showing a projection pattern.

FIG. 31 is a view showing the arrangement tendency of a filament image projected by the region 28(1). The filament images 38(yi) (i=1 to 6) located at a position on the line H—H or an upper position with respect to the line H—H are filament images projected by several representative points on the crossing line where the plane y=yi (i=1 to 6) crosses the curved surface of the region 28(1).

As shown in the drawing, the filament images 38(y1), 38(y3) and 38(y5) are located on the right of the line V—V. The higher the y-coordinate value of the filament image is, the closer to the line V—V the filament image is located.

The filament images 38(y2), 38(y4) and 38(y6) are located on the left of the line V—V. The higher the y-coordinate value of the filament image is, the closer to the line V—V the filament image is located.

The filament image 38(y0) located on the line V—V is a projection image formed by a point located on a boundary line between the regions 28(1) and 28(2). In this case, the boundary line is a portion of the crossing line on the side z>0 where the plane (y=y0 (=0)) crosses the reflection surface 26*a*.

Figure 32:
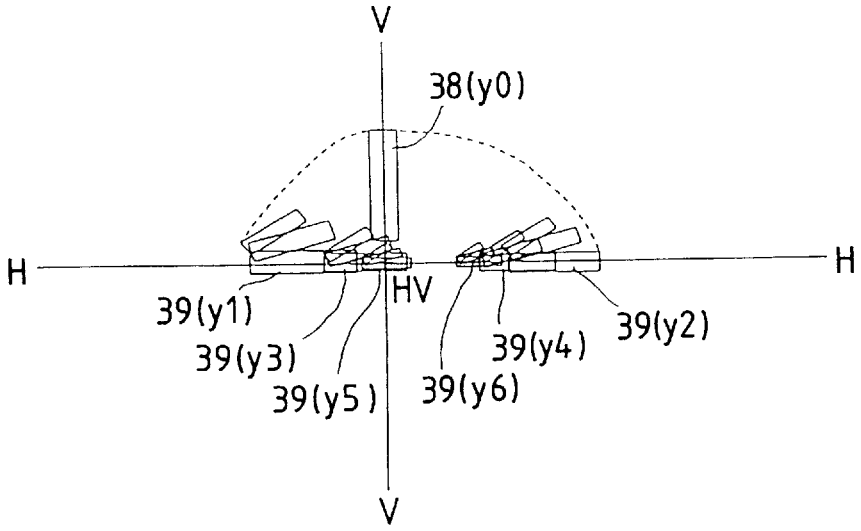
FIG. 32 is a view showing an arrangement tendency of the filament image formed by the region 28(2) and also showing a projection pattern.

FIG. 32 is a view showing an arrangement tendency of the filament image projected by the region 28(2). The filament images 39(yi) (i=1 to 6) located at a position on the line H—H or an upper position with respect to the line H—H are filament images projected by several representative points on the crossing line where the plane y=yi (i=1 to 6) crosses the curved surface of the region 28(2). The arrangement tendency is opposite to that of the filament image 38(yi) with respect to the line V—V.

The filament images 39(y1), 39(y3) and 39(y5) are located on the left of the line V—V. The higher the y-coordinate value of the filament image is, the closer to the line V—V the filament image is located.

The filament images 39(y2), 39(y4) and 39(y6) are located on the right of the line V—V. The higher the y-coordinate value of the filament image is, the closer to the line V—V the filament image is located.

Figure 33:
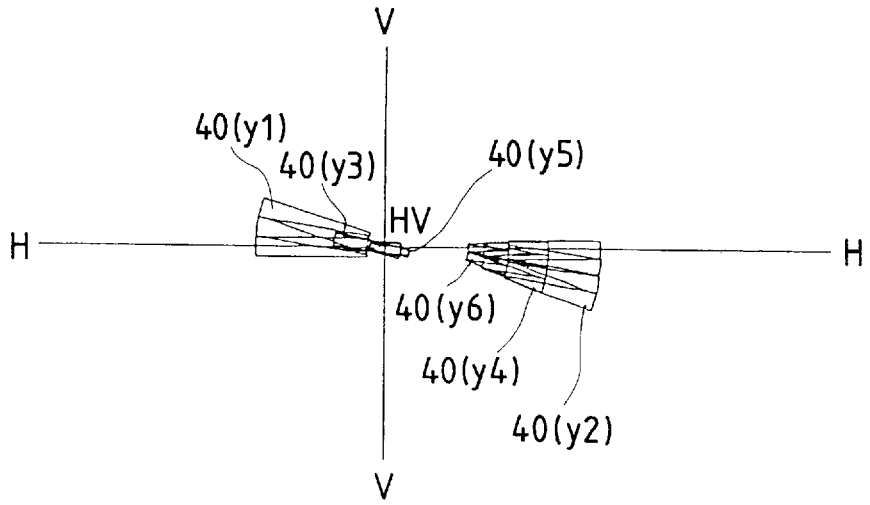
FIG. 33 is a view showing an arrangement tendency of the filament image formed by the region 28(3) and also showing a projection pattern.

FIG. 33 is a view showing an arrangement of the filament images projected by the region 28(3). The filament images 40(yi) (i=1 to 6) located at a position on the line H—H or a position close to the line H—H are filament images projected by several representative points on the crossing line where the plane y=yi (i=1 to 6) crosses the curved surface of the region 28(3).

The filament images 40(y1) and 40(y3) are located on the left of the line V—V. They are arranged radially around the point HV. The filament image 40(y3) is located at a position closer to the point HV than the filament image 40(y1). The filament image 40(y5) is located at a position close to the point HV.

The filament images 40(y2), 40(y4) and 40(y6) are located on the right of the line V—V at a position on the line H—H or at a lower position with respect to the line H—H. The higher the y-coordinate value of the filament image is, the closer to the line V—V the filament image is located.

Figure 34:
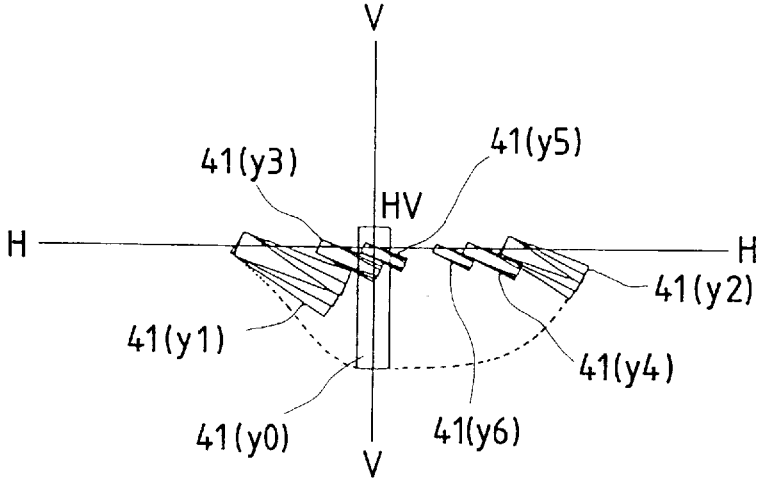
FIG. 34 is a view showing an arrangement tendency of the filament image formed by the region 28(4) and also showing a projection pattern.

FIG. 34 is a view showing the arrangement of filament images projected by the region 28(4). The filament images 41(yi) (i=1 to 6) located at a substantially lower position with respect to the line H—H are filament images projected by several representative points on the crossing line where the plane y=yi (i=1 to 6) crosses the curved surface of the region 28(4).

As shown in the drawing, the filament images 41(y1) and 41(y3) are located on the left of the line V—V. The higher the y-coordinate value of the filament image is, the closer to the line V—V the filament image is located. The filament image 41(y5) is located close to the point HV.

The filament images 41(y2), 41(y4) and 41(y6) are located at a lower position with respect to the line H—H on the right of the line V—V. The higher the y-coordinate value of the filament image is, the closer to the line V—V the filament image is located.

In this connection, the filament image 41(y0) located on the line V—V is a projection image formed by a point located on a boundary line between the regions 28(3) and 28(4). In this case, the boundary line is a portion of the crossing line on the side z<0 where the plane (y=y0 (=0)) crosses the reflection surface 26*a*.

Figure 35:
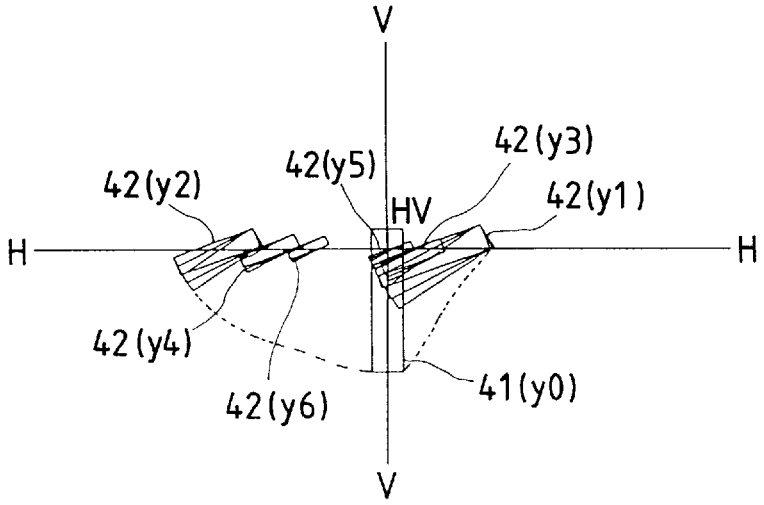
FIG. 35 is a view showing an arrangement tendency of the filament image formed by the region 28(5) and also showing a projection pattern.

FIG. 35 is a view showing an arrangement of the filament images projected by the region 28(5). The filament images 42(yi) (i=1 to 6) located at a position on the line H—H are filament images projected by several representative points on the crossing line where the plane y=yi (i=1 to 6) crosses the curved surface of the region 28(5). The arrangement tendency is opposite to that of the filament image 41(yi) with respect to the line V—V.

The filament images 42(y1) and 42(y3) are located on the right of the line V—V. The higher the y-coordinate value of the filament image is, the closer to the line V—V the filament image is located. The filament image 42(y5) is located close to the point HV.

The filament images 42(y2), 42(y4) and 42(y6) are located at a position almost on the line H—H on the left of the line V—V. The higher the y-coordinate value of the filament image is, the closer to the line V—V the filament image is located.

Figure 36:
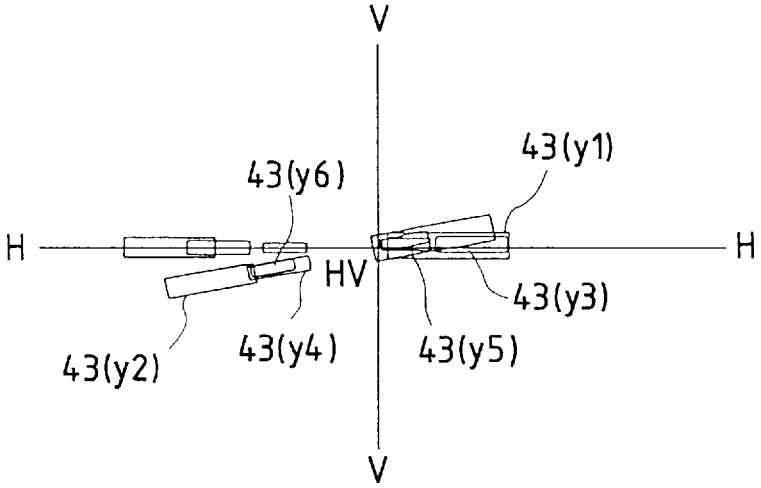
FIG. 36 is a view showing an arrangement tendency of the filament image formed by the region 28(6) and also showing a projection pattern.

FIG. 36 is a view showing an arrangement of the filament images projected by the region 28(6). The filament images 43(yi) (i=1 to 6) located at a position on the line H—H or a position close to the line H—H are filament images projected by several representative points on the crossing line where the plane y=yi (i=1 to 6) crosses the curved surface of the region 28(6).

The filament images 43(y1), 43(y3) and 43(y5) are located at a position almost on the line H—H immediately on the right of the line V—V. The higher the y-coordinate value of the filament image is, the closer to the line V—V the filament image is located.

The filament images 43(y2), 43(y4) and 43(y6) are located at a position close to the line H—H on the left of the line V—V. The higher the y-coordinate value of the filament image is, the closer to the line V—V the filament image is located.

Figure 37:
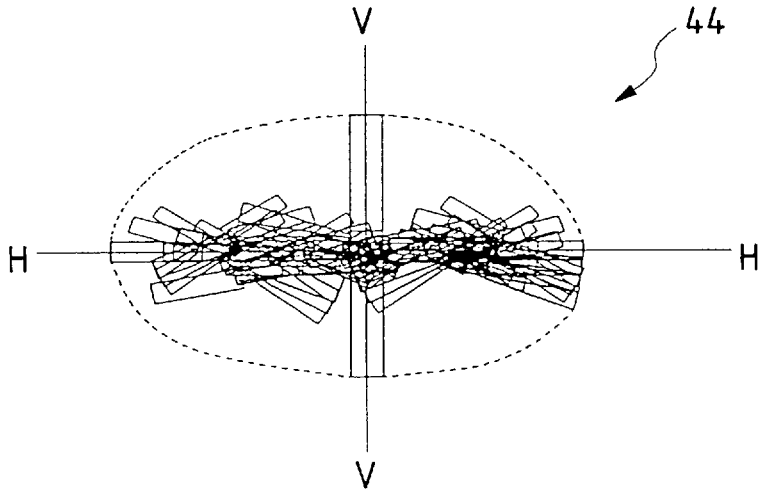
FIG. 37 is a view showing a projection pattern in which projection patterns formed by the regions 28(1) to 28(6) are compounded.

FIG. 37 is a schematic illustration of the projection pattern 44 obtained as a set of the filament images having the above tendencies. The projection pattern 44 is formed into an ellipse, the center of which is the point HV, wherein the major axis is arranged in the transverse direction.

Figure 38:
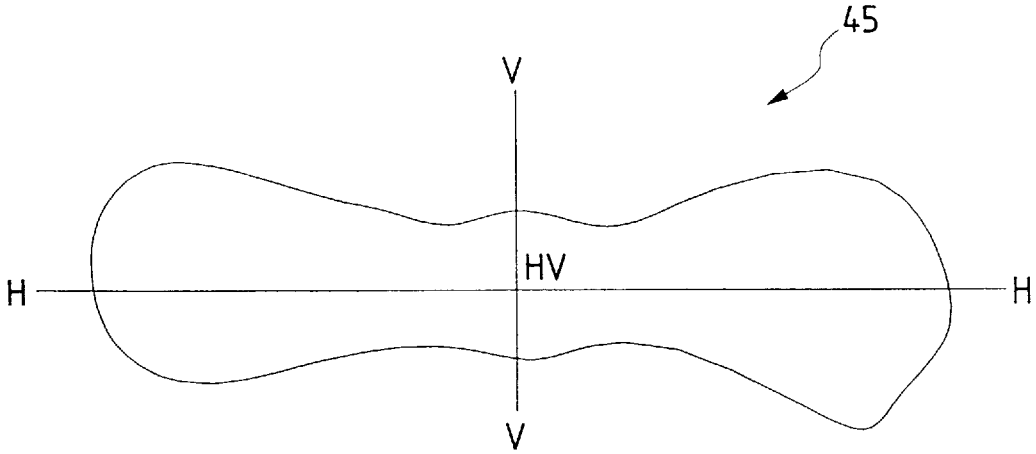
FIG. 38 is a schematic illustration of the projection pattern reflected by a reflection surface that is obtained by an addition of the damping periodic function with respect to a basic surface of the reflection surface.

FIG. 38 is a schematic illustration of the projection pattern 45 formed by the reflection surface 26*a* which has been formed into a wave-shape in the manner described before.

The projection pattern 45 is obtained as a result of wave-form processing conducted by the damping periodic function only on a region of the reflection surface 26*a* close to the x-axis, wherein the above projection patter 44 is used as an original form. The projection pattern 45 is formed in such a manner that the above projection pattern 44 is greatly diffused in the horizontal direction.

The light distribution pattern of a lamp is finally obtained by the action of the front lens conducted on the projection pattern formed by the reflection surface 26*a*. However, according to the reflection mirror of the present invention, a light distribution pattern to satisfy the predetermined light distribution standard can be obtained by the action of the reflection surface 26*a*. Accordingly, it is possible to use a front lens without any function to modify the light or with little function to modify the light.

Figure 39:
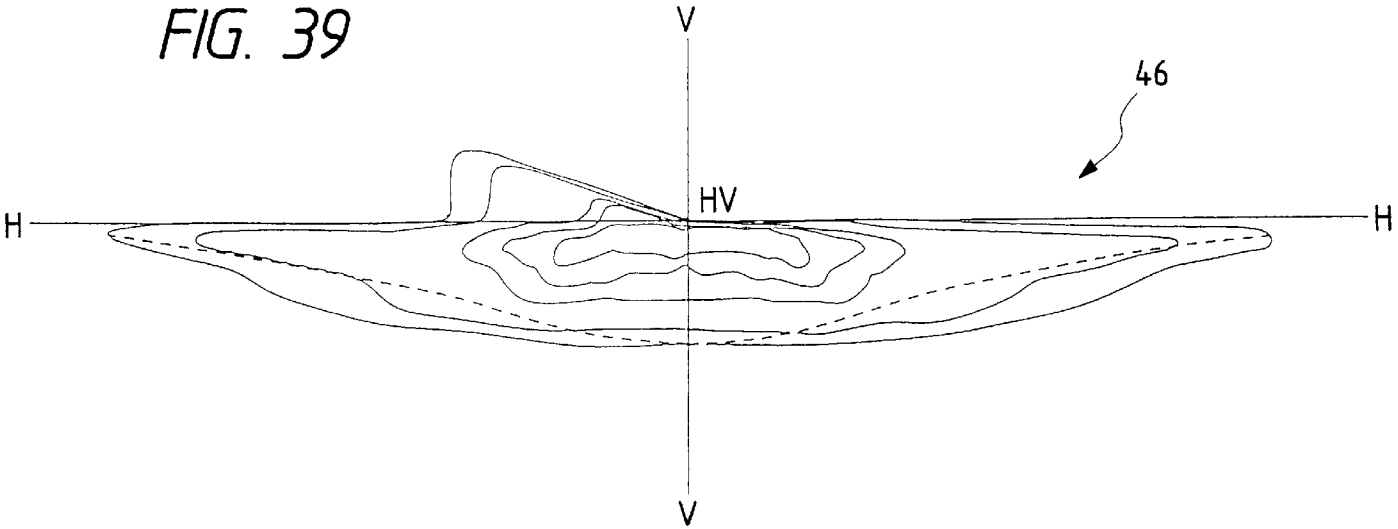
FIG. 39 is a schematic illustration showing a light distribution in the case of irradiation of a low beam.
Figure 40:
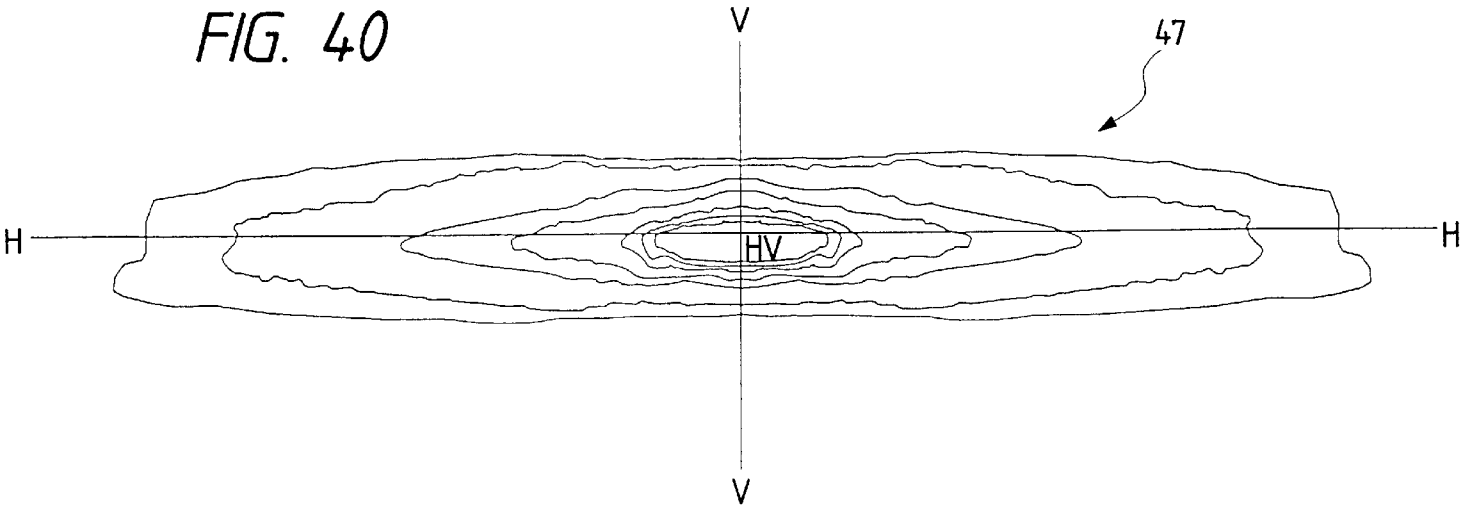
FIG. 40 is a schematic illustration showing a light distribution in the case of irradiation of a main beam.
Figure 41:
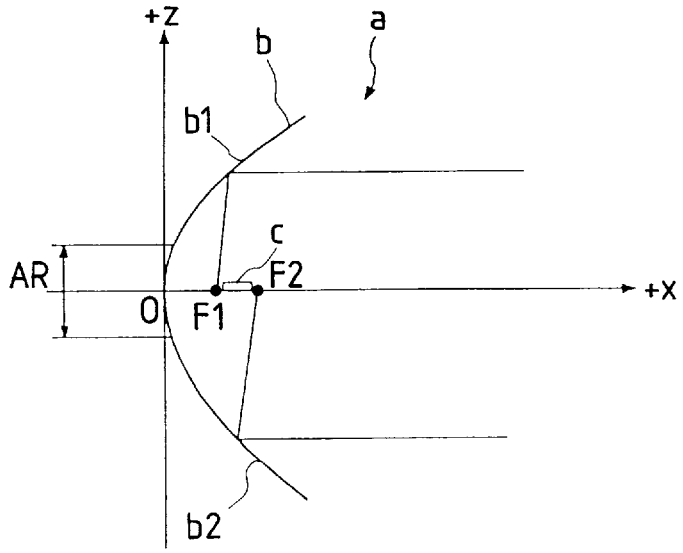
FIG. 41, in conjunction with FIGS. 42 to 44, is a view in which a curved surface is formed while an elliptical reference curve is established on a horizontal surface containing the optical axis, and is a longitudinal cross-sectional view.
Figure 42:
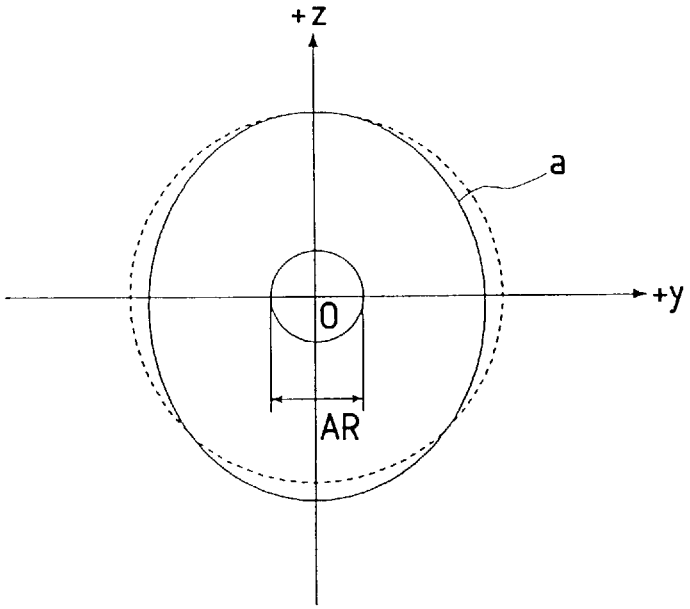
FIG. 42 is a front view.
Figure 43:
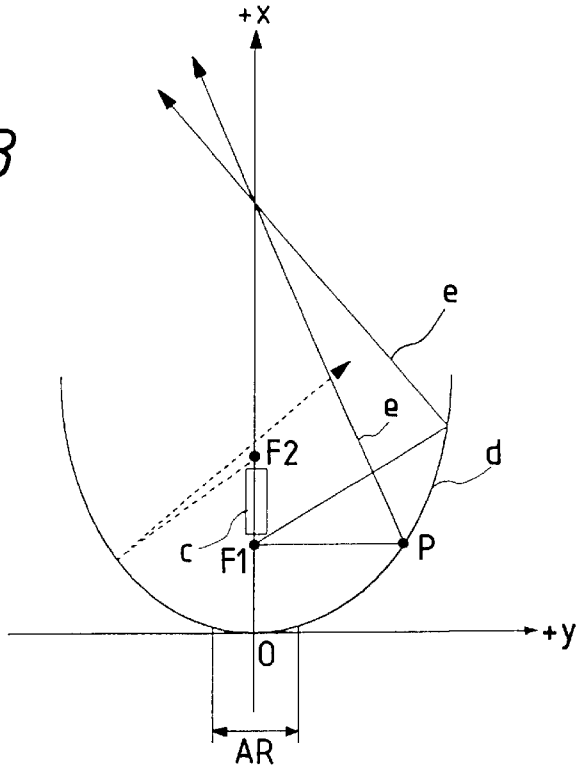
FIG. 43 is a horizontal cross-sectional view.
Figure 44:
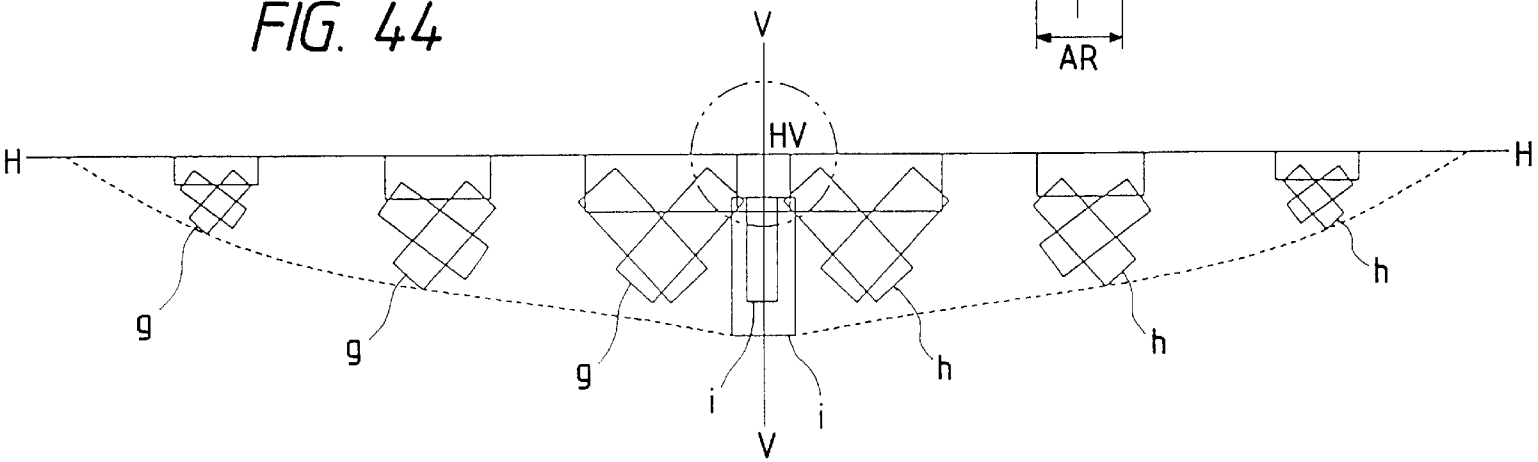
FIG. 44 is a schematic illustration showing an arrangement tendency of the filament image projected in front of the reflection surface.
Figure 45:
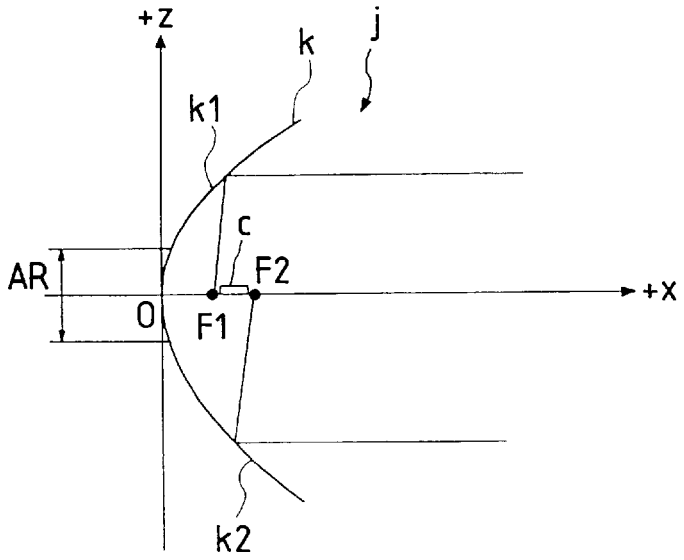
FIG. 45, in conjunction with FIGS. 46 to 48, is a view in which a curved surface is formed while a hyperbolic reference curve is established on a horizontal surface containing the optical axis, and is a longitudinal cross-sectional view.
Figure 46:
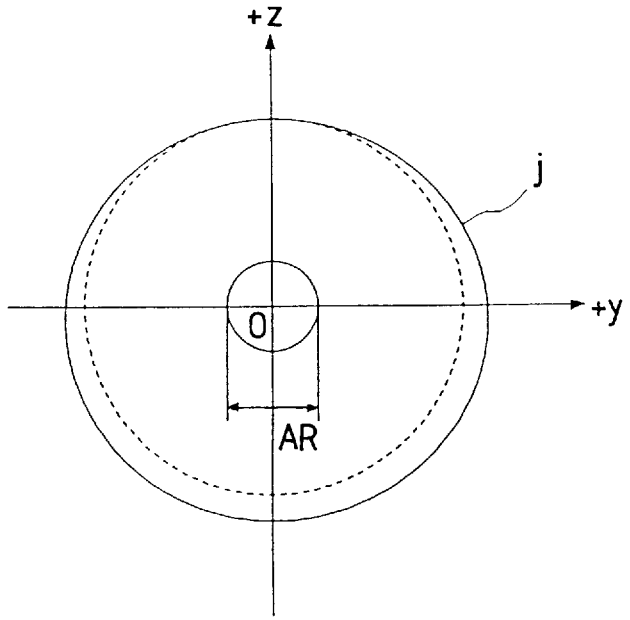
FIG. 46 is a front view.
Figure 47:
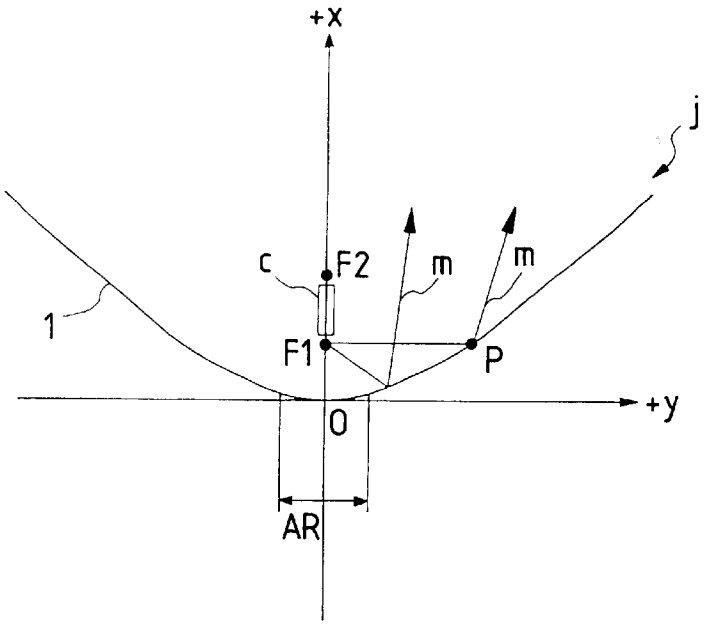
FIG. 47 is a horizontal cross-sectional view.
Figure 48:
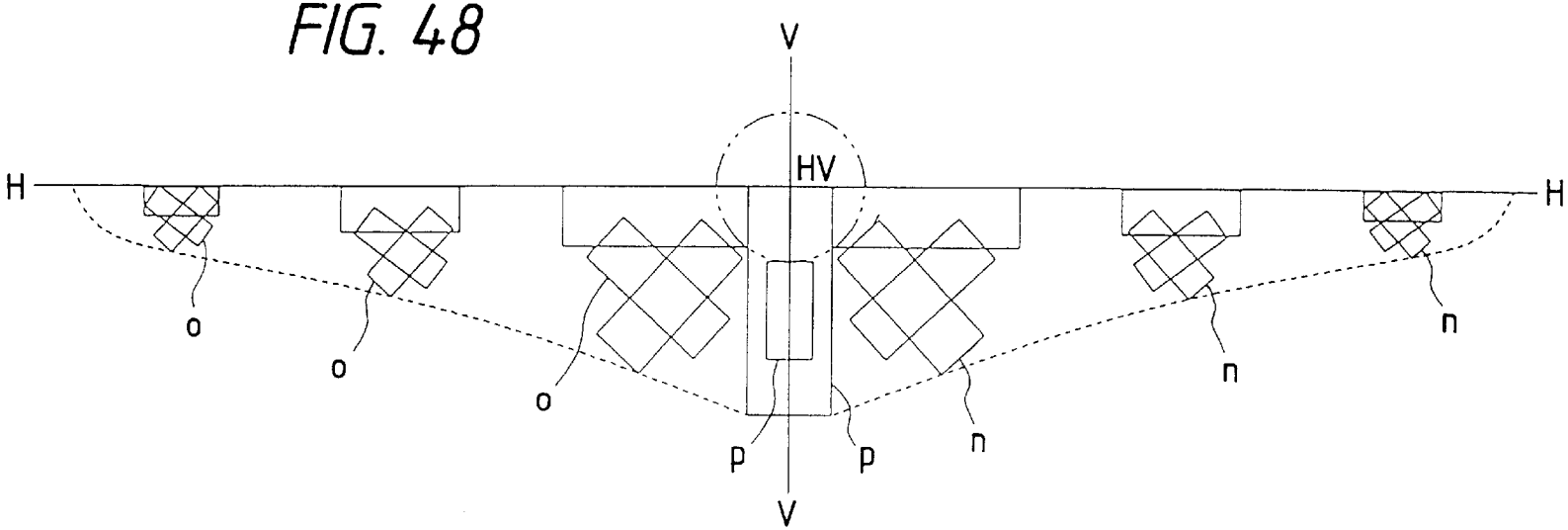
FIG. 48 is a schematic illustration showing an arrangement tendency of the filament image projected in front of the reflection surface.

FIGS. 39 and 40 are schematic illustrations showing light distribution patterns. FIG. 39 is a view showing a light distribution pattern 46 relating to a low beam, and FIG. 40 is a light distribution pattern 47 relating to a main beam. A broken line in FIG. 39 is shown as a comparative example and indicates a lower edge of the light distribution pattern in the case of using a reflection surface "a" shown in FIGS. 41 to 43 or a reflection surface "j" shown in FIGS. 45 to 47. In the above comparative example, the width of the light distribution pattern in the vertical direction is sharply reduced as it is separate from the line V—V. On the other hand, in the light distribution pattern 46 according to the present invention, the width of the light distribution pattern in the vertical direction can be sufficiently ensured as illustrated in the drawing.

As can be seen above, according to the invention, when the reference curve is formed by repeatedly arranging a hyperbolic portion and an elliptical portion, a filament image, the projection area of which is large, obtained by the center of a reflection surface can be greatly diffused in the horizontal direction, so that rays of light can be diffused in the horizontal direction while the width in the vertical direction is sufficiently ensured. Also, a filament image, the projection area of which is small, obtained by the periphery of a reflection surface can be collected at the central luminous intensity portion in the light distribution pattern. Therefore, it is possible to ensure the central luminous intensity required by the light distribution standard. Accordingly, it is possible to solve such a problem that both end portions of a light distribution pattern in the horizontal direction become slender and the visibility is lowered in the periphery. Tt is also possible to solve such a problem that a necessary quantity of light is not sent to the central luminous intensity portion as a result of making an attempt of diffusing light in the horizontal direction.

Further, according to the present invention, when a parabolic portion is interposed between the hyperbolic portion and the elliptical portion on the reference curve, or when the hyperbolic portion or the elliptical portion on the reference curve is continued to a parabolic portion in the periphery on the reflection surface, the curve portions composing the reference curve can be smoothly connected with each other.

Still further, according to the present invention, based on a function composed of a product of the normal distribution function and the periodic function, an overall reflection surface or a portion of the reflection surface is formed into a wave-shape, so that rays of light can be more diffused in the horizontal direction. In this way, the degree of dependence of the reflection mirror upon the diffusing action of the front lens can be greatly reduced.

What is claimed is:

1. A head lamp for a vehicle comprising a light source and reflection mirror having an optical axis and being capable of providing a light distribution pattern having a light distribution in which rays of light are diffused in a horizontal direction and a central luminous intensity is maintained at a predetermined level, said reflection mirror comprising:

(a) a reference curve having a focus and being set on a horizontal surface containing said optical axis;

(b) said reference curve being a compound curve comprising at least one hyperbolic curve portion having a focus on said optical axis and at least one elliptical curve portion having a focus on said optical axis, said at least one hyperbolic curve portion and said at least one elliptical curve portion being aligned in a direction different from that of said optical axis;

(c) an angle of reflected light with respect to the optical axis at a point on each of said hyperbolic and elliptical curve portions of said reference curve becoming larger as said curve portions are disposed closer to said optical axis; and (d) said reflection surface having an axis parallel with a light vector of reflected light obtained when light assumed to be emitted from a reference point of said reference curve located on said optical axis is reflected at an arbitrary point on said reference curve, said reflection surface being define as set of crossing lines obtained when an imaginary surface of a paraboloid of revolution passing through the reflecting point, the focus of which is said reference point, is cut by an imaginary plane parallel with a vertical axis containing said light vector.

2. A head lamp for a vehicle according to claim 1, wherein a parabolic curve portion is interposed between a hyperbolic curve portion and an elliptical curve portion of the reference curve.

3. A head lamp for a vehicle according to claim 1, wherein one of a hyperbolic curve portion and an elliptical curve portion continues to an end curve portion at the periphery of said reflection surface that is not hyperbolic or elliptical.

4. A head lamp for a vehicle according to claim 3, wherein said end curve portion is parabolic.

5. A head lamp for a vehicle according to claim 1 wherein at least a portion of said reflection surface is subject to a diffusion enhancing function comprising a product of a normal distribution function and a periodic function, whereby said portion of the reflection surface is formed into a wave-shape.

6. A head lamp for a vehicle according to claim 5 wherein substantially all of said reflection surface is subject to said diffusion enhancing function.

7. A head lamp for a vehicle according to claim 2 wherein at least a portion of said reflection surface is subject to a diffusion enhancing function comprising a product of a normal distribution function and a periodic function, whereby said portion of the reflection surface is formed into a wave-shape.

8. A head lamp for a vehicle according to claim 7 wherein substantially all of said reflection surface is subject to said diffusion enhancing function.

9. A head lamp for a vehicle according to claim 3 wherein at least a portion of said reflection surface is subject to a diffusion enhancing function comprising a product of a normal distribution function and a periodic function, whereby said portion of the reflection surface is formed into a wave-shape.

10. A head lamp for a vehicle according to claim 9 wherein substantially all of said reflection surface is subject to said diffusion enhancing function.

11. A head lamp for a vehicle according to claim 1 wherein said reflection surface has an insertion hole for inserting said light source formed at a substantial center of a reflection surface, a central axis of said light source inserted into said reflection mirror through said insertion hole extending along said optical axis, and said light source being located close to a reference point which is set apart from the focus of said reference curve.

12. A head lamp for a vehicle according to claim 11 wherein said reference point is disposed in the front or at the rear of said focus of said reference curve.

13. A head lamp for a vehicle according to claim 1 comprising a plurality of hyperbolic curve portions and a plurality of elliptical curve portions, said elliptical curve portions and hyperbolic curve portions being alternatively repeated.

14. A head lamp for a vehicle according to claim 11 comprising a plurality of hyperbolic curve portions and a plurality of elliptical curve portions, said elliptical curve portions and hyperbolic curve portions being alternatively repeated.

15. A head lamp for a vehicle comprising a light source and reflection mirror having an optical axis and being capable of providing a light distribution pattern having a light distribution in which rays of light are diffused in a horizontal direction and a central luminous intensity is maintained at a predetermined level, said reflection mirror comprising:

(a) a reference curve having a focus and at least a portion of said curve being obtained when a projectable curve is projected on the horizontal surface containing the optical axis, said projectable curve being set on a surface inclined by a predetermined angle around the optical axis with respect to the horizontal surface containing the optical axis;

(b) said reference curve being a compound curve comprising at least one hyperbolic curve portion having a focus on said optical axis and at least one elliptical curve portion having a focus on said optical axis, said at least one hyperbolic curve portion and said at least one elliptical curve portion being aligned in a direction different from that of said optical axis;

(c) an insertion hole for inserting a light source formed at a substantial center of a reflection surface, a central axis of a light source inserted into the reflection mirror through the insertion hole extending along the optical axis, and the light source being located close to a reference point which is set apart from the focus of said reference curve;

(d) an angle of reflected light with respect to the optical axis at a point on each of said hyperbolic and elliptical curve portions of said reference curve becoming larger as said curve portions are disposed closer to said optical axis; and (e) said reflection surface having an axis parallel with a light vector of reflected light obtained when light assumed to be emitted from a reference point of said reference curve located on said optical axis is reflected at an arbitrary point on said reference curve, said reflection surface being defined as set of crossing lines obtained when an imaginary surface of a paraboloid of revolution passing through the reflecting point, the focus of which is said reference point, is cut by an imaginary plane parallel with a vertical axis containing said light vector.

16. A head lamp for a vehicle according to claim 15, wherein a parabolic curve portion is interposed between a hyperbolic curve portion and an elliptical curve portion of the reference curve.

17. A head lamp for a vehicle according to claim 15, wherein one of a hyperbolic curve portion and an elliptical curve portion continues to a parabolic curve portion at the periphery of said reflection surface.

18. A head lamp for a vehicle according Lo claim 15 wherein at least a portion of said reflection surface is deformed by a function comprising a product of a normal distribution function and a periodic function, whereby said at least a portion of said reflection surface is formed into a wave-shape.

19. A head lamp for a vehicle according to claim 16 wherein at least a portion of said reflection surface is deformed by a function comprising a product of a normal distribution function and a periodic function, whereby said at least a portion of said reflection surface is formed into a wave-shape.

20. A head lamp for a vehicle according to claim 17 wherein at least a portion of said reflection surface is deformed by a function comprising a product of a normal distribution function and a periodic function, whereby said at least a portion of said reflection surface is formed into a wave-shape.

21. A head lamp for a vehicle according to claim 15 comprising a plurality of hyperbolic curve portions and a plurality of elliptical curve portions, said elliptical curve portions and hyperbolic curve portions being alternatively repeated.

22. A head lamp for a vehicle comprising a light source and reflection mirror having an optical axis extending from a center portion thereof and being capable of providing a light distribution pattern having a light distribution in which rays of light are diffused in a horizontal direction and a central luminous intensity is maintained at a predetermined level, said reflection mirror:

(a) being defined by a reference curve having a focus and at least a portion of said curve being obtained when a projectable curve is projected on the horizontal surface containing the optical axis, said projectable curve being set on a surface inclined by a predetermined angle around the optical axis with respect to the horizontal surface containing the optical axis, said reference curve being formed by repeatedly arranging a hyperbolic portion and an elliptical portion; and (b) comprising:

means for producing a first plurality of filament images, the distortion of which is large, having a large projection area, obtained by a portion close to the center of said reflection surface, that is greatly diffused in the horizontal direction, so that the vertical width at the end portion of the light distribution pattern in the horizontal direction can be sufficiently ensured; and means for producing a second plurality of filament images, the distortion of which is small, having a small projection area, obtained by a portion close to the periphery of said reflection surface that is controlled so that it can contribute to the formation of a central luminous intensity portion in the light distribution pattern.

23. A head lamp for a vehicle according to claim 22 wherein at least a portion of said reflection surface is deformed by a function comprising a product of a normal distribution function and a periodic function, whereby said at least a portion of said reflection surface is formed into a wave-shape.

24. A method of forming a head lamp for a vehicle comprising a reflection mirror capable of providing a light distribution pattern having a light distribution in which rays of light are diffused in a horizontal direction and a central luminous intensity is maintained at a predetermined level, comprising the steps of:

(a) setting a light source so that a central axis of the light source can be extended along an optical axis and located at a position close to a reference point of a reference curve when at least a portion of the reference curve is set on a horizontal surface containing the optical axis, or when at least a portion of the reference curve is obtained when a projectable curve is projected on the horizontal surface containing the optical axis, the projectable curve being set on a surface inclined by a predetermined angle around the optical axis with respect to the horizontal surface containing the optical axis;

(b) composing the reference curve by forming in such a manner that a hyperbolic curve portion having a focus on the optical axis and an elliptical curve portion also having a focus on the optical axis are alternately repeated in a direction separate from the optical axis, and determining a shape of the reference curve in such a manner that the closer the curve portion of the reference curve to the optical axis is, the large an angle of reflecting light, which is emitted from a light source and reflected at a point in each of the curve portions of the reference curve, with respect to the optical axis is;

(c) setting an imaginary surface of paraboloid of revolution having an axis parallel with a light vector of reflecting light obtained when light assumed to be emitted from a reference point of the reference curve located on the optical axis is reflected at an arbitrary point on the reference curve, the imaginary surface of paraboloid of revolution passing through the reflecting point, the focus of the imaginary surface of paraboloid of revolution being the reference point;

(d) finding crossing lines when the imaginary surface of paraboloid of revolution is cut by an imaginary plane parallel with a vertical axis containing the light vector; and (e) forming a reflection surface as a sit of the crossing lines obtained when the operation described in items (c) and (d) is repeated on an arbitrary point on the reference curve.

25. A method of forming a head lamp for a vehicle according to claim 24, wherein an addition according to a function composed of a product of a normal distribution function and a periodic function is conducted on the reflection surface, so that an overall reflection surface or a portion of the reflection surface is formed into a wave-shape.

* * * * *